United States Patent [19]

Hershberger

[11] 4,225,751

[45] Sep. 30, 1980

[54] VARIABLE-ANGLE, MULTIPLE CHANNEL AMPLITUDE MODULATION SYSTEM

[75] Inventor: David L. Hershberger, Quincy, Ill.

[73] Assignee: Harris Corporation, Melbourne, Fla.

[21] Appl. No.: 970,652

[22] Filed: Dec. 18, 1978

[51] Int. Cl.[2] ..... H04H 5/00

[52] U.S. Cl. ..... 179/1 GS; 329/167; 329/178; 332/23 A; 332/40

[58] Field of Search ..... 179/1 GS; 325/36; 329/50, 146, 167, 178; 332/23 A, 21, 22, 42, 41, 40, 37 D; 333/14

[56] References Cited

U.S. PATENT DOCUMENTS

| | | | |
|---|---|---|---|
| 2,903,518 | 9/1959 | Kahn | 179/1 GS |
| 3,067,293 | 12/1962 | Moore | 179/1 GS |
| 3,102,167 | 8/1963 | Barton | 179/1 GS |
| 3,218,393 | 11/1965 | Kahn | 325/36 |
| 3,233,044 | 2/1966 | Hopper | 179/1 GE |
| 3,377,559 | 4/1968 | Stewart | 333/14 |

*Primary Examiner*—Douglas W. Olms

[57] ABSTRACT

A compatible AM stereo system employing a modified quadrature modulation scheme where the gain in the quadrature-phased channel, and thus the phase angle between the L and R modulated phase components of the composite modulated signal, is dynamically varied in accordance with changing modulation conditions. The average phase angle between the L and R modulated phase components is much greater than was previously possible in fixed gain systems, thus signal-to-noise ratio (SNR) in stereophonic receivers is improved. In the transmitter (FIGS. 3, 7A and 7B), a matrix circuit (40, 188) adds and subtracts L and R audio signals to produce sum (L+R) and difference (L−R) signals. An analog divider (54; 194, 200) adjusts the gain of the (L−R) signal in accordance with a gain control signal $A_Q$. The (L+R) and gain adjuster (L−R) signals are transmitted on two quadrature-phased carriers by a quadrature AM (QAM) transmitter (50, 160). A distortion estimator (56, 190, FIGS. 5A and 5B) calculates the amount of distortion which the envelope of the composite modulated signal will produce in a conventional monophonic receiver and dynamically adjusts the gain control signal $A_Q$ to maximize gain without exceeding predetermined distortion constraints. A circuit (60, 210, FIGS. 9 and 10) generates a pilot signal and modulates it with the dynamically varying gain control. This pilot signal is added to, and thus transmitted with, the gain adjusted (L−R) signal. In one transmitter embodiment (FIG. 7A and 7B), a circuit (156, FIG. 8) is provided for compressing low amplitude audio signals so as to further improve SNR. A signal indicative of the amounts of compression is also modulated onto the pilot signal, and thus transmitted to the receiver. A filter network (154) provides a gap in the low frequency portion of the (L−R) signal into which the pilot signal may be inserted, and processes the (L+R) and (L−R) signals so that no loss in bass occurs as a result of this filtering. Stereophonic receivers (FIGS. 11–13) are disclosed which demodulate the pilot signal and control the gain of the recovered (L+R) and (L−R) signals in accordance therewith so as to track the varying phase angle and signal compression of the composite modulated signal, and thus optimally recover the L and R audio signals in their original form. The system may easily be converted into an improved independent sideband (ISB) system by the insertion of appropriate phase delays in the (L+R) and (L−R) signal paths.

48 Claims, 16 Drawing Figures

DISTORTION ESTIMATOR ATTACK/RELEASE CIRCUIT

LIMITER CONTROL

AM PILOT DET. AND DEMOD

AM PILOT SIG. GEN. AND MODULATOR

FM PILOT SIG. GEN. AND MODULATOR

VARIABLE-ANGLE, MULTIPLE CHANNEL AMPLITUDE MODULATION SYSTEM

CROSS REFERENCE TO RELATED APPLICATIONS

Related co-pending, commonly assigned patent applications include Leitch "Compatible AM Stereo System Employing a Modified Quadrature Modulation Scheme", Ser. No. 019,837, filed Mar. 12, 1979, continuation of Ser. No. 812,657, filed July 5, 1977, now abandoned; Leitch "AM Stereo Receivers", Ser. No. 829,518, filed Aug. 31, 1977; Smiley "Direct Function Receivers and Transmitters for Multichannel Communications Systems", Ser. No. 935,142, filed Aug. 21, 1978; and Hershberger "Asynchronous Multichannel Receiver", Ser. No. 934,811, filed Aug. 18, 1978.

BACKGROUND AND FIELD OF THE INVENTION

The present invention relates to multichannel communications systems, and more particularly to a compatible AM stereo system employing a modulated signal having differently phased carriers, where the phase angle between the carriers is dynamically varied.

Interest in transmitting stereophonic information over the AM frequency band has existed for more than 50 years, nearly as long as commercial AM broadcasting, itself, has existed. During this time, many different schemes have been suggested for communicating the stereophonically-related audio signals from the broadcasting station to the radio receivers. None of these schemes, however, has met with general approval by the broadcasting community since none has demonstrated a clear superiority over the others.

A number of criteria are commonly used in comparing the performance of the various systems. Generally stated, these criteria include the quality of stereophonic reproduction in stereophonic receivers and the compatibility of the transmitted stereo signal for reception by currently available (monophonic) AM receivers. In addition, it is desired that the stereophonic signals transmitted should not occupy any greater RF bandwidth than that presently allocated for monophonic AM transmission.

More specifically, the stereophonic performance of an acceptable AM stereo system should be such that, upon reception, the signal-to-noise ratio is as great as possible. In any event, it should not be significantly degraded as compared to reception obtainable with current monophonic systems. Also, the distortion introduced by the transmission and reception of the stereo signal should be minimal. Finally, the separation between the stereophonically related signals (usually referred to as the left (L) and right (R) signals) should be as great as possible.

With respect to mono-compatibility, any acceptable AM stereo system must be fully compatible with monophonic receivers currently available on the market. In other words, the detection of the composite stereo signal with the monophonic envelope detectors and product detectors currently in use should produce a signal corresponding to the sum (L+R) of the two stereophonically related signals, without noticeable distortion. Additionally, the loss in the loudness of the received signal in monophonic receivers due to the stereophonic nature of the broadcast signal should be as low as possible.

In a system proposed by Harris Corporation several differently-phased carriers are separately modulated and then added together to produce the composite modulated signal for transmission. One of the carrier signals is modulated by the L (left) audio signal, whereas the other carrier is modulated by the R (right) audio signal. In this system, referred to as the compatible phase modulation system (or CPM system), the angle between the two modulated carriers (referred to occasionally hereinafter as "modulated phase components") is set to a value of around 30°. In another method of generating the same composite modulated signal, a conventional quadrature AM transmitter is used. A signal corresponding to the sum of L and R audio signals is used to modulate the in-phase channel, and a signal corresponding to the weighted difference between the L and R audio signals is used to modulate the quadrature-phase signal. The angle of 30° between the L and R modulated phase components in the resulting composite modulated signal is established by appropriate weighting of the quadrature-phase modulating signal.

Signal-to-noise ratio (SNR) in stereophonic receivers for receiving this signal is dependent upon the phase angle employed, and would be greater at greater phase angles. It would therefore be desirable to utilize a phase angle which is greater than 30° in order to improve SNR in stereophonic receivers. Unfortunately, to do so would increase distortion in conventional monophonic receivers to above acceptable levels.

BRIEF SUMMARY OF THE INVENTION

It is an object of the present invention to provide a compatible AM stereo system which increases SNR in stereophonic receivers without increasing worst case distortion in monophonic receivers.

It is another object of the present invention to provide a compatible AM stereo system wherein the phase angle between modulated phase components of the composite stereo signal can be increased without a commensurate increase in worst case distortion in monophonic receivers.

It is yet another object of the present invention to provide a system for generating a composite modulated signal including several modulated phase components, wherein the phase angle between the modulated phase components may be dynamically varied in any desired manner.

It is still another object of the present invention to provide stereophonic receivers for receiving and demodulating a composite modulated signal including several modulated phase components, wherein the receiver is controllable to provide optimum demodulation of a signal having any given phase angle between the modulated phase components thereof.

It is even another object of the present invention to provide a system wherein a stereophonic receiver may be controlled from a stereophonic transmitter so as to automatically track variations in the stereophonic signal transmitted to the receiver from the transmitter.

It is a further object of the present invention to provide a stereophonic system wherein a modulated pilot signal is transmitted in the composite modulated signal along with the stereophonic information, without loss in any stereophonic information due to the inclusion of the modulated pilot signal.

It is another object of the present invention to provide a compatible AM stereo system wherein SNR is further improved by compressing low level signals at the transmitter and automatically expanding them by corresponding amounts at the receiver.

It is another object of the present invention to provide a circuit for estimating the amount of distortion in the envelope of the composite modulated signal and for controlling the phase angle between the modulated phase components thereof so as to limit the distortion to a preselected maximum.

It is still a further object of the present invention to provide a receiver for receiving a stereophonic signal including a modulated pilot signal, wherein the pilot signal is eliminated from the stereophonic signal by a signal cancellation technique.

It is another object of the present invention to also provide an independent sideband AM stereo system which achieves each of the foregoing objects.

The present invention provides an improved system wherein the phase angle between the two modulated phase components is dynamically varied in such a manner as to provide optimum stereophonic and monophonic performance under varying modulation conditions. The modulating system includes means for monitoring the amount of distortion which will be present when the signal is demodulated in a conventional monophonic receiver. The phase angle between the modulated phase components is then adjusted so as to be as close to 90° as possible, without causing the distortion to exceed predetermined constraints.

To remain within these constraints, the phase angle will be reduced to as little as 30° under certain modulation conditions. Often, though, the phase angle will be much larger. When at these larger phase angles, however, signal-to-noise ratio will be improved in stereophonic receivers.

In order to vary the phase angle between the modulated phase components, the disclosed embodiments utilize quadrature modulation and vary the weighting of the quadrature-phase component in accordance with the desired phase angle. Thus, the L and R signals are matrixed to produce (L+R) and (L−R) signals. The (L+R) signal is used to modulate the in-phase component of the composite modulated signal, whereas the (L−R) signal is amplitude adjusted in accordance with the desired phase angle, and then used to modulate the quadrature-phase component of the composite modulated signal.

Optimum demodulation of the composite modulated signal at a subsequent receiver can only be provided when the receiver is provided with information as to the dynamic variations of the phase angle between the two phase components of the modulated signal. In the disclosed embodiments, the modulator provides a low frequency pilot signal which is modulated in accordance with this information. This pilot signal is added to the quadrature channel and is thus transmitted along with the composite modulated signal. The receiver extracts from the pilot signal the information indicative of the dynamically varying phase angle, and utilizes that information to optimally recover the L and R signals.

The present invention also contemplates that the pilot signal which is used to communicate the phase information to the receiver will also be modulated with other signal processing information. Preferably, the modulator will include signal compression circuitry for compressing the dynamic range of the audio signals by increasing the amplitude of low level L and R signals to thereby further increase the signal-to-noise ratio of the system. The pilot signal is then modulated with the information indicative of the amount of compression of the signals, so that the receiver can expand the signals by a corresponding amount by reducing their gain to thereby recover the signals in their original form.

Moreover, a modified independent-sideband (ISB) system may be derived from the disclosed system simply by introducing a relative phase shift of 90° between the (L+R) and (L−R) audio signals at the transmitter, with a complimentary phase shift of −90° being provided at the receiver. The composite modulated signal communicated between the transmitter and receiver in this system will have the L information predominantly carried in one sideband and the R information predominantly carried in the other. Due to the dynamic variation in the phase angle, however, the envelope of the composite modulated signal will again never differ from the desired compatible form by more than a preselected amount.

BRIEF DESCRIPTION OF THE DRAWINGS

The foregoing and other aspects and advantages of the present invention will become more readily apparent from the following detailed description, as taken in conjunction with the accompanying drawings, wherein.

DETAILED DESCRIPTION OF THE DRAWINGS

Figure 1:
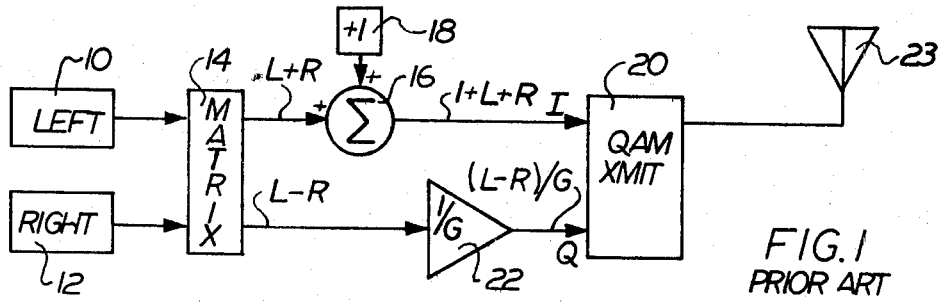
FIG. 1 PRIOR ART
FIG. 1 is a block diagram of a prior art modulator/-transmitter system.

There is illustrated in FIG. 1 a block diagram of a prior art modulator/transmitter utilizing a modified quadrature modulation technique. Two signal sources 10 and 12 produce the stereophonically related left (L) and right (R) audio signals which are to be communicated to the receiving station. The L and R audio signals are supplied to a matrix circuit 14 which adds them together to produce a sum signal (L+R) and subtracts them from one another to produce a difference signal (L−R). A DC component is added to the (L+R) signal by means of a signal adder circuit 16 which sums the (L+R) signal with a DC signal supplied by a circuit 18. The output of signal adder 16 has the form (1+L+R) and is supplied to the in-phase modulating input I of a QAM transmitter 20. The (L−R) signal, on the other hand, is supplied to the quadrature phase modulating input Q through a gain circuit 22. The output of gain circuit 22 has the form of (L−R)/G. The QAM transmitter 20 modulates each of two quadrature-phased carrier signals in accordance with a corresponding one of the two modulating signals, linearly combines (i.e. adds) the two resulting modulated carrier signals, and transmits the resulting signal via an antenna 23.

Both synchronous and nonsynchronous forms of stereophonic receivers may be constructed which will be capable of separating the sum and difference signals from the composite modulated signal as transmitted by the transmitter of FIG. 1. The composite modulated signal may also be received by conventional monophonic receivers. Monophonic receivers using product detectors will synchronously detect the in-phase component of a composite modulated signal, and will thus automatically recover the sum signals (L+R) alone. Monophonic signals utilizing envelope detection techniques, however, will experience some amount of distortion due to the existence of the quadrature-phase component. This is because the envelope of the composite modulated signal will represent a vector addition of the in-phase and quadrature-phase components of the composite modulated signal. The envelope thus differs in form from the desired (1+L+R) form by an amount which varies with the amplitude of the (L−R) component.

Figure 2A:
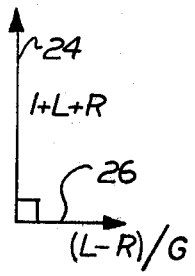
FIGS. 2A and 2B are vector diagrams useful in understanding the nature of the modulated signals provided by the circuitry of FIG. 1.
Figure 2B:
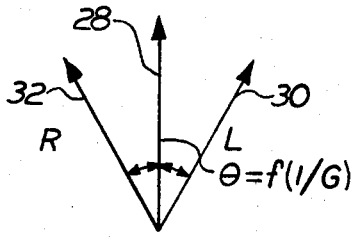

This may be more readily understood through reference to FIGS. 2A and 2B, which are vectoral representations of two different but equivalent characterizations of the composite modulated signal transmitted by the prior art modulator of FIG. 1. In FIG. 2A, the composite modulated signal is characterized as a combination of an in-phase vector 24 and a quadrature-phase vector 26. The composite modulated signal $V_c$ may thus be described by the mathematical expression:

$$V_c=[1+L+R]\ \mathrm{Cos}\ w_c t+[(L-R)/G]\ \mathrm{Sin}\ w_c t, \quad (1)$$

Where $W_c$ is the carrier frequency, in radians per second.

This mathematical expression can be shown to be equivalent to the alternative expression:

$$V_c=[(L)\ \mathrm{Cos}\ (w_c t-\theta)+(R)\ \mathrm{Cos}\ (w_c t+\theta)]\ \mathrm{Secant}\ \theta+\mathrm{Cos}\ w_c t \quad (2)$$

Where:

$$\theta=f(1/G)=\arctan\ (1/G) \quad (3)$$

FIG. 2B provides a vectoral representation of equation 2, and illustrates the second manner in which the composite modulated signal may be characterized. In this vector diagram, the vector 28 represents a continuous, unmodulated carrier signal, whereas vectors 30 and 32 represent differently-phased carriers modulated with the L and R signals. These modulated carriers are often referred to herein as modulated phase components. These phase components are phased at equal and opposite angles of $\theta$ on either side of the carrier vector 28. As indicated at (3) above, the angle separating the L and R vectors will vary with the gain factor 1/G of gain circuit 22 of FIG. 1.

The envelope of the composite modulated signal will have an amplitude which is the vector sum of vectors 24 and 26 of FIG. 2A, which, of course, is equivalent to the vector sum of vectors 28, 30, and 32 of FIG. 2B (since both vector diagrams characterize the same signal). This amplitude function will identically represent (1+L+R) when the gain factor 1/G has a value of 0 or when L=R. When 1/G=0 the vector 26 of the vector diagram of FIG. 2A will be nonexistent, and the angle between the L and R vectors 30 and 32 of the FIG. 2B vector diagram will be 0 so that the two vectors are coextensive. In either event, only the L+R component will remain. As the gain factor 1/G increases from 0 to 1 (alternatively stated, as the phase angle between the L and R vectors 30 and 32 increases from 0 to 90 degrees) the amount by which the envelope will differ from the (1+L+R) value will similarly increase, producing a corresponding increase in distortion in monophonic receivers.

In the Harris CPM system, the phase angle between the L and the R vectors is set equal to 30°. In this event, the amount of distortion in a monophonic receiver employing an envelope detector will never exceed acceptable limits. Furthermore, under many signal circumstances, the amount of distortion will be significantly below this limit. Thus, when the L and the R signals are essentially identical, the L−R component will virtually vanish, resulting in the demodulation of an essentially distortion free signal by an envelope detector. In other words, as the content of the L and R signals changes, the amount of distortion experienced in an envelope detector will also change.

The signal-to-noise ratio (SNR) in stereophonic receivers is also affected by the phase angle between the L and R vectors, but in a different direction. The signal-to-noise ratio, unlike distortion, will be at its optimum (highest) value when the phase angle between the L and R vectors is 90°, and will deteriorate as the phase angle is reduced towards zero. To improve signal-to-noise ratio, then, it would be desirable to increase the phase angle above the 30° value used in the CPM system. To do so, however, would result in a commensurate increase in worst case distortion in monophonic receivers to above acceptable limits.

In the system in accordance with the present invention, signal-to-noise ratio in stereophonic receivers is improved without a commensurate increase in worst case distortion. This is accomplished by including circuitry at the transmitter for continuously monitoring the actual level of distortion which will be produced in a monophonic receiver by the envelope of the composite modulated signal, and then setting the phase angle between the L and R vectors as close to 90° as possible without causing that distortion to exceed the worst case limit. The phase angle is thus dynamically varied with the changing modulation conditions. Under conditions of low modulation the phase angle will always be 90° and SNR will be high. For high modulation with high amplitude (L−R), the angle, and hence SNR are reduced. However, due to the well known noise masking phenomenon, preceived SNR will be that of a static 90° system.

Figure 3:
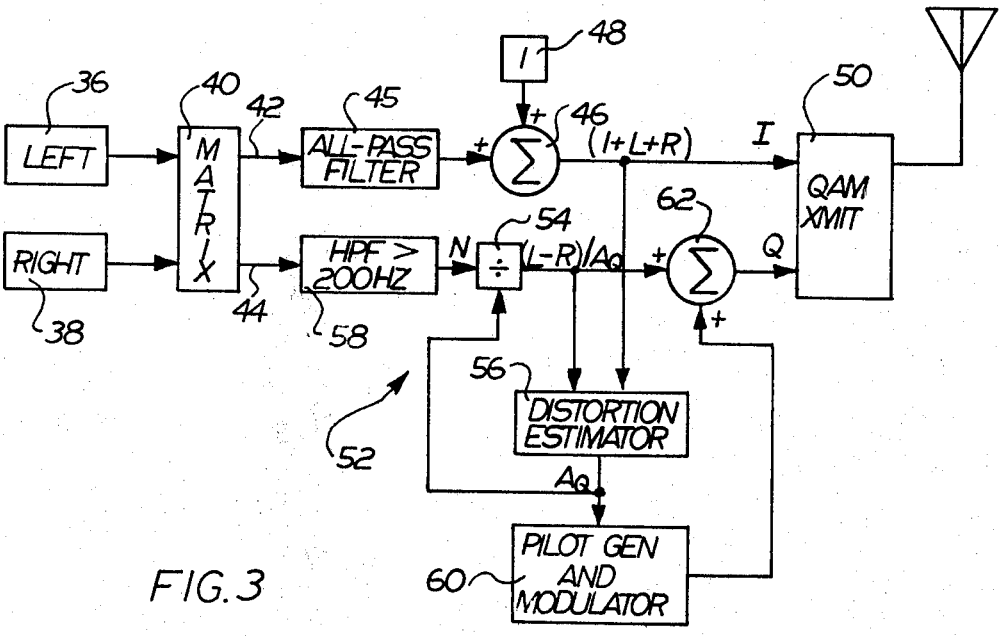
FIG. 3 is a broad block diagram of a modulator/-transmitter system in accordance with the teachings of the present invention.

FIG. 3 illustrates a modulator/transmitter in accordance with the teachings of the present invention. As in the prior art, two signal sources 36 and 38 provide two stereophonically related audio signals to a matrix circuit 40, which adds and subtracts them to respectively provide sum and difference signals along output lines 42 and 44. The sum signal is supplied to signal adder 46 through an all-pass filter 45, whose purpose will be described hereinafter. Signal adder 46 adds a DC component provided by a circuit 48 to the sum signal to produce the in-phase modulating signal, in this embodiment having essentially the same form as the in-phase modulating signal utilized in the prior art system of FIG. 1. This signal is directed to the in-phase modulating input I of a QAM transmitter 50.

The difference signal output 44 of matrix circuit 40 is connected to the quadrature-phase modulating input Q of the QAM transmitter 50 via a processing circuit 52. This processing circuit operates to change the gain of the difference signals (and thus the phase angle between the L and R vectors of the composite modulated signal) by an amount which, unlike prior art systems, will dynamically vary with the program content of the audio signals being transmitted. More specifically, the processing circuit 52 includes an analog divider circuit 54 for dividing the difference signal by a second analog signal supplied by a distortion estimator 56. If the gain control signal $A_Q$ supplied to the analog divider 54 by the distortion estimator increases, then the gain of the difference signals supplied to the Q channel of the QAM transmitter will be reduced. Similarly, if the gain control signal $A_Q$ is reduced, then the gain of the difference signal supplied to the QAM transmitter 50 will increase. It should be noted that the phase angle could also be varied by changing the gain of the (L+R) signal or by changing the gains of both the (L+R) and (L−R) signals, but by different amounts. For simplicity and improved mono-compatibility, however, it is preferred that the gain of only the (L−R) signal be changed, with the (L+R) signal being kept at a fixed gain.

The outputs of summing circuit 46 and divider circuit 54 are connected to the inputs to distortion estimator 56, which calculates the form which the envelope of the composite modulated signal will have. If this differs from the desired "compatible" form (i.e. from the 1+L+R) signal) by more than a predetermined limit (3–4%, for example), the amplitude of the gain control signal is increased so as to reduce the gain of the difference signal by the amount necessary to reduce the amount of distortion to the selected limit. If, on the other hand, the amount of distortion is sufficiently below the selected limit, then the gain control signal is permitted to decrease to a lower value, increasing the gain of the difference signal and effectively increasing the phase angle between the L and R vectors 30 and 32 of FIG. 2B. In this fashion, the distortion estimator operates to dynamically vary the gain of the quadrature channel modulating signal in accordance with a program content so that the phase angle between the L and R vectors 30 and 32 (FIG. 2B) is as great as possible without exceeding the predetermined distortion constraints. This provides optimum SNR within the distortion constraints.

In order for a stereophonic receiver to demodulate the composite modulated signal produced by the transmitter of FIG. 3 with maximum fidelity, it is necessary for the receiver to know what the phase angle between the L and R vectors is at any given time. The modulator of FIG. 3 transmits this information to the receiver via a modulated pilot signal, added to the quadrature-phase channel.

In order to make room in the frequency spectrum of the quadrature-phase channel for the insertion of the pilot signal, a high-pass filter 58 is included. This high-pass filter eliminates all frequencies below a predetermined limit (for example, 200 Hz) from the difference signal. As is well known, these lower frequencies contribute very little towards the stereophonics of the signal, and thus may be deleted without significant adverse effects to the stereophonic reception of the signal. This filter does, however, introduce significant phase shift in signals having frequencies close to the predetermined limit. The all-pass filter 45 in the sum signal path is provided to introduce a similar frequency-dependent phase shift in the sum signal. If this were not provided, the phase difference between the sum and difference signals would interfere with the de-matrixing of the signals in a stereophonic receiver. The all-pass filter does not, however, affect the amplitude versus frequency characteristics of the sum signal.

A pilot generator and modulator 60 generates a pilot signal having a medium frequency below the pass frequency of filter 58, and modulates it in accordance with the gain signal being supplied to the divider 54 from the distortion estimator 56. In the illustrated embodiment, for example, the medium frequency of the pilot signal is 80 Hz. The modulated pilot signal, which has a frequency bandwidth falling entirely within the frequency band deleted from the quadrature-phase channel, is then added to the quadrature-phase modulating channel by an adder 62.

Figure 4:
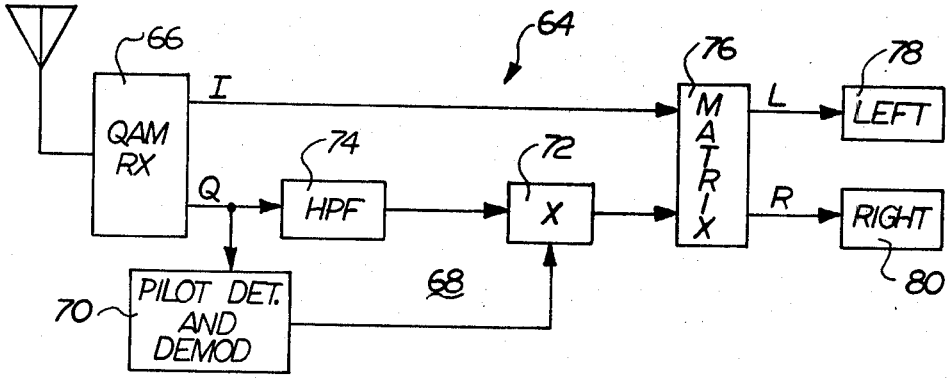
FIG. 4 is a broad block diagram of a receiver for receiving and demodulating signals generated by the circuitry of FIG. 3.

FIG. 4 illustrates a radio receiver 64 for receiving and demodulating the composite modulated signal produced by the modulator/transmitter of FIG. 3. This receiver 64 includes a conventional QAM receiver 66 for demodulating and separating out the in-phase and quadrature-phase modulating signals from the composite modulated signal. These two signals corresponds to the signal provided to the QAM transmitter 50.

The receiver also includes a circuit, generally indicated at 68, for correcting the amplitude of the quadrature-phase modulated signal in accordance with the modulation of the pilot signal. This circuit includes a pilot detector and demodulator 70 for recovering the gain control signal which had been modulated thereon by the pilot generator and modulator 60 of FIG. 3. A multiplier 72 multiplies the quadrature-phase modulating signal by the gain signal to produce a difference signal at its output having a corrected gain. A high-pass filter 74 eliminates those frequencies in the quadrature-phase modulating signal below a predetermined limit (200 Hz in the described embodiment), thus eliminating the pilot signal and passing only the difference signal to the multiplier 72. If desired, an all-pass filter may be provided in the in-phase channel to add a frequency-dependent phase shift similar to that created by the high-pass filter 74.

The recovered in-phase modulating signal, corresponding to the sum signal (1+L+R) and the gain-corrected quadrature-phase modulating signal, corresponding to the difference signal (L−R), are provided to an audio matrix circuit 76 which adds them to separate out the left audio signal L and subtracts them to separate out the right audio signal R. The DC component of the in-phase modulating signal may be eliminated in any conventional manner, as by including a DC blocking capacitor in the matrix circuit 76 or in the individual left and right utilization means 78 and 80. The utilization means 78 and 80 will usually be audio amplifiers and loudspeakers, but may, of course, also take other forms.

Figure 5A:
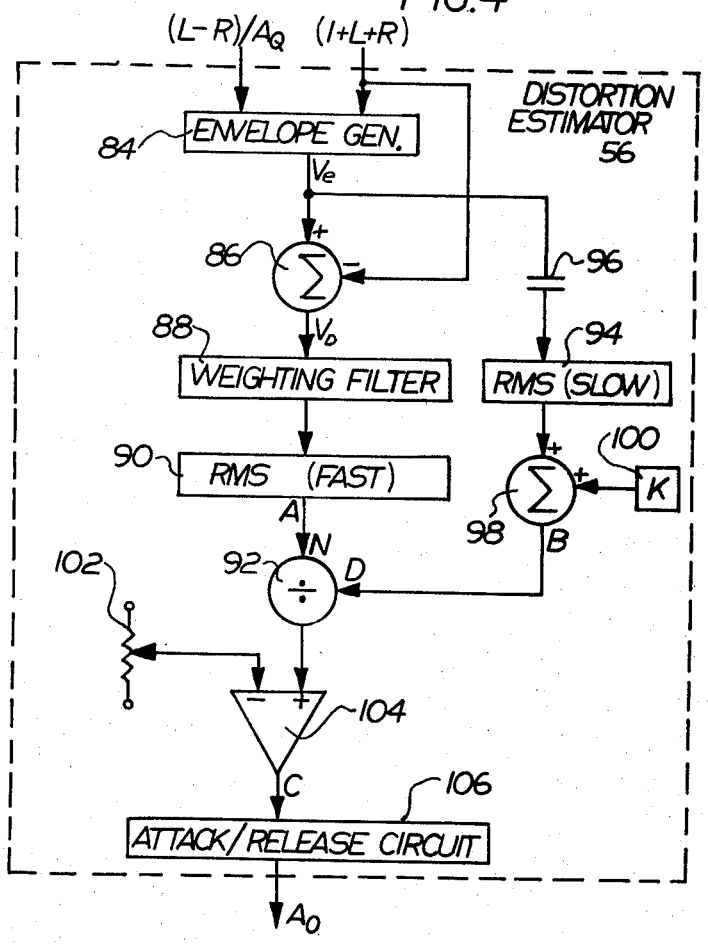
FIGS. 5A and 5B are more detailed block diagrams of the distortion estimator block of the block diagram of FIG. 3.

FIG. 5A is a more detailed block diagram of the distortion estimator 56 utilized in the modulator/transmitter of FIG. 3. As can be seen in this figure, the distortion estimator 56 includes an envelope generator 84 which responds to the sum and difference signals to generate a signal $V_e$ at its output corresponding to the vector sum thereof. More specifically, the envelope generator 84 computes the squareroot of the sum of the squares of the two input signals (L−R) and (1+L+R). This envelope generator may take any conventional form, and could, for example, be a vector module model VM 101, manufactured by Intronics. This signal $V_e$ represents the actual envelope of the composite modulated signal, as it would be detected in a monophonic receiver utilizing an envelope detector.

A signal subtractor 86 subtracts a signal indicative of the ideal compatible envelope form (1+L+R) from the actual envelope $V_e$ to produce a difference signal $V_d$ at its output. A weighting filter 88 selectively weights different frequencies in the signal $V_d$ in accordance with the sensitivity of the human ear and/or other criteria, and provides a weighted output to a fast RMS detector 90. The RMS detector 90 detects the RMS (root-mean-squared) value of the output of the weighting filter 88, to thereby provide a signal having an amplitude indicative of the amount of distortion which would be produced in a monophonic receiver by the signals then present at the input to the distortion estimator.

A divider circuit 92 divides this absolute distortion estimate by a signal indicative of the magnitude of the AC component of the envelope so as to normalize the distortion in accordance with the magnitude of the envelope and thereby provide an estimate of the percent of distortion. The signal indicative of the magnitude of the AC portion of the envelope is produced by a second RMS converter 94 which is provided with the envelope signal $V_e$ through a DC blocking capacitor 96. A signal adder 98 adds a small DC value, provided a circuit 100, to the signal at the output of the RMS converter 94 so that the input to the normalization divider 92, in the absence of modulation, does not drop to zero.

The percent distortion, as indicated by at the output of divider 92, is compared in a comparator 104 with a preset limit (for example, 3–4%) established by potentiometer 102. The output of the comparator 104 will remain low as long as the percent distortion in the envelope is below the limit set by the potentiometer 102. When the percent distortion increases above this preset limit, however, the output of comparator 104 will shift to a high level, causing an attack/release circuit 106 to increase the amplitude of the gain control signal supplied to the divider 54 (FIG. 3). Thus, an increase in distortion above the acceptable limit established by potentiometer 102 will result in a reduction in the gain of the quadrature-phase component, thereby reducing the amount of distortion in the envelope. Eventually a point will be reached at which the percent distortion is below the limit set by potentiometer 102, at which time the output of comparator 104 will again drop to a low voltage level. The attack/release circuit 106 will then stop slewing the gain control signal $A_Q$ in the positive direction, and instead will permit the gain control signal to decay with time. Therefore, if the percent distortion drops to a lower level due to a change in the program content of the signals, the gain control signal will also decay to a lower level, permitting the amplitude of the quadrature-phase component to increase. At some point, the quadrature-phase component will increase to the point where the percent distortion is again equal to the predetermined limit, resulting in the actuation of the comparator 104 and the increase in amplitude of the gain control signal. The distortion estimator 56 thus varies the gain control signal so that the percent distortion does not exceed the predetermined limit established in the potentiometer 102.

Figure 5B:
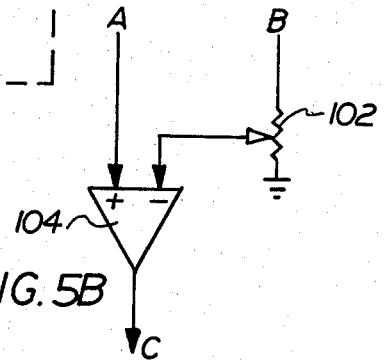

FIG. 5B illustrates an alternative arrangement for a portion of the distortion estimator 56. This alternative arrangement eliminates the need for the divider 92 for normalization of the output of RMS convertor 90. In the circuit of FIG. 5B, the potentiometer 102 is connected to the output of signal adder 98 so that the distortion limit signal provided to comparator 104 will automatically vary with the amplitude of the AC component of the envelope. This limit is then directly compared with the output of RMS converter 90 via the comparator 104. This circuit will function in the same fashion as that set forth in FIG. 5A, but does not need a divider 92 since the limit signal, instead of the distortion signal, is changed with the amplitude of the AC component of the envelope.

Figure 6:
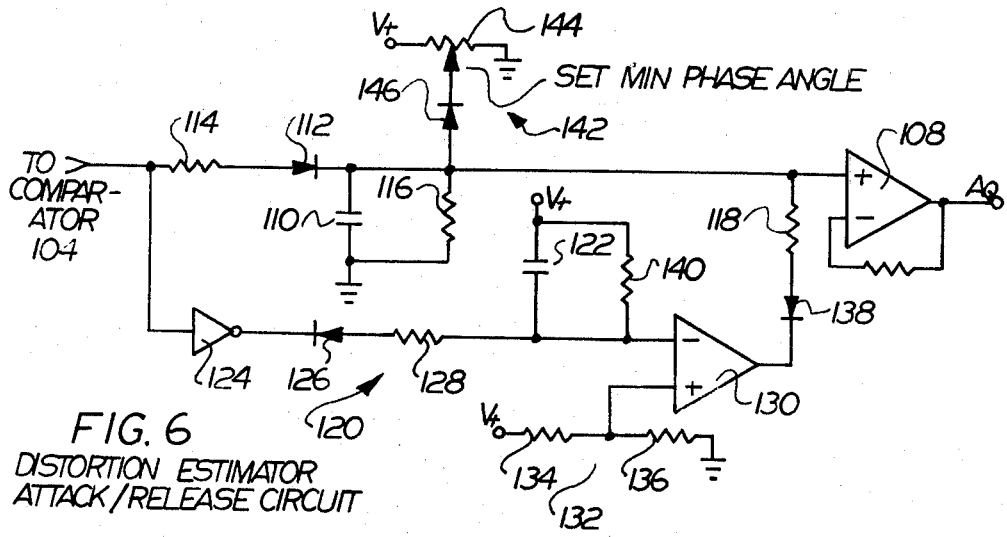
FIG. 6 is a more detailed block diagram of the attack-/release circuit of the distortion estimator of FIG. 5A.

FIG. 6 illustrates a more detailed circuit schematic of attack/release circuit 106 of the distortion estimator of FIGS. 5A and 5B. This circuit includes a capacitor 110 across which a voltage is developed representative of the gain signal to be supplied to the divider circuit 54 of FIG. 1. This gain control signal is supplied to the divider circuit 54 via a unity gain buffer 108. The comparator 104 is connected to the capacitor 110 through a resistor 114 and a diode 112. The resistor 114 sets the rate at which the voltage across capacitor 110 will increase when the output of comparator 104 goes high. This resistor therefore sets the attack time of the circuit. Preferably, the resistor 114 will be set so that the attack time of the circuit will be quite low, on the order of 20 milliseconds, for example.

The voltage across capacitor 110 decays as a result of current flow through two resistors 116 and 118. Since resistor 116 has a quite high resistance value, the decay of the voltage across capacitor 110 is essentially established by resistor 118. Decay of the voltage across capacitor 110 is prevented, during that portion of time in which the output of comparator 104 is high, by a circuit generally indicated at 120. When the output of comparator 104 goes to a high voltage level, the voltage across a capacitor 122 in circuit 120 will be charged to a ground voltage level via an inverter 124, a diode 126 and a resistor 128. Thus, since the input to inverter 124 is at a high voltage level, the output thereof will be at a low (ground) voltage level, so that the capacitor 122 will charge to a ground voltage level through the resistor 128. This resistor is selected so that this charge time is much smaller than the attack time of the attack/release circuit. The voltage at the junction of resistor 128 and capacitor 122 is connected to a comparator 130 which compares the voltage at this node with a fixed voltage established by a resistive divider 132 including resistors 134 and 136. When the voltage across capacitor 122 charges towards a ground potential, the output of comparator 130 will shift to a high logic level. This reverse biases a diode 132 serially interconnected with the resistor 118. Since the diode 132 is reverse biased, essentially no current will flow through resistor 118 and no decay of the voltage across capacitor 110 will take place.

When the output of comparator 104 returns to a low logic level, indicating that the distortion has dropped to acceptable levels, the output of comparator 130 will remain at a high logic level until the voltage across capacitor 122 decays up to a voltage which is greater than the voltage established at the junction of resistors 134 and 136. Consequently, for a brief interval following the release of comparator 104, no decay of the voltage across capacitor 110 will take place. More specifically, when the output of comparator 104 shifts to a low level, the output of inverter 124 will shift to a high level, thus reverse biasing diode 126 and essentially disconnecting capacitor 122 from ground. The capacitor 122 will therefore charge up to a positive voltage via a resistor 140 which is connected across it. When the voltage across capacitor 122 charges up to the point at which that voltage exceeds the voltage at the junction of resistors 134 and 136, the output of comparator 130 will drop to a low voltage level. The diode 138 will thus become forward biased, permitting discharging of capacitor 110 to take place through resistor 118. The gain control signal will thereafter decay at a rate established by the resistance value of resistor 118.

A clipping circuit 142 is included to clip the maximum voltage across capacitor 110 at a preset limit. This prevents the phase angle between the L and R vectors components of the composite modulated signal (or, equivalently, the amplitude of the quadrature-phase component) from being reduced below a certain limit, preferably about 30°. Clipping circuit 142 includes a potentiometer 144, having its wiper arm connected to capacitor 110 through a diode 146. In operation, diode 146 will be reverse biased as long as the voltage across capacitor 110 does not exceed the voltage at the wiper arm of potentiometer 144. As the voltage across capacitor 110 increases beyond this voltage, however, diode 146 will become forward biased, and current will be shunted past the capacitor 110 through the potentiometer 144. The resistance value of potentiometer 144 is selected to be small enough so that the current flow therethrough due to the forward biasing of diode 146 will not significantly change the voltage at the wiper arm. The clipping circuit 142 therefore prevents the voltage across capacitor 110 from exceeding the voltage at the wiper arm of potentiometer 144. The maximum voltage across capacitor 110, and thus the minimum phase angle, may be set by adjusting potentiometer 144.

Figure 7A:
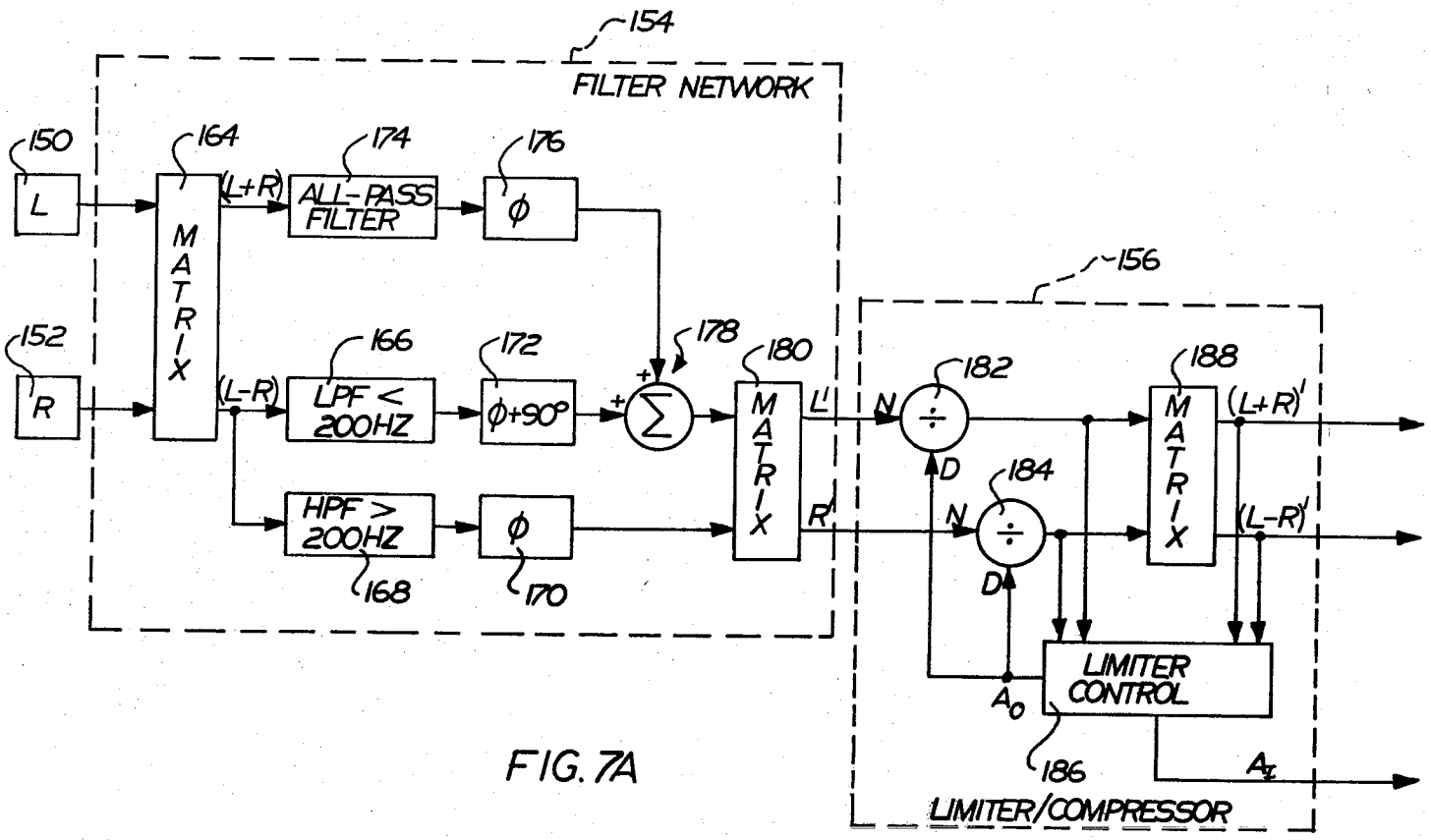
FIGS. 7A and 7B are more detailed illustrations of a practical embodiment of a modulator/transmitter in accordance with the teachings of the present invention, and incorporating selective compression of the low level audio signals.
Figure 7B:
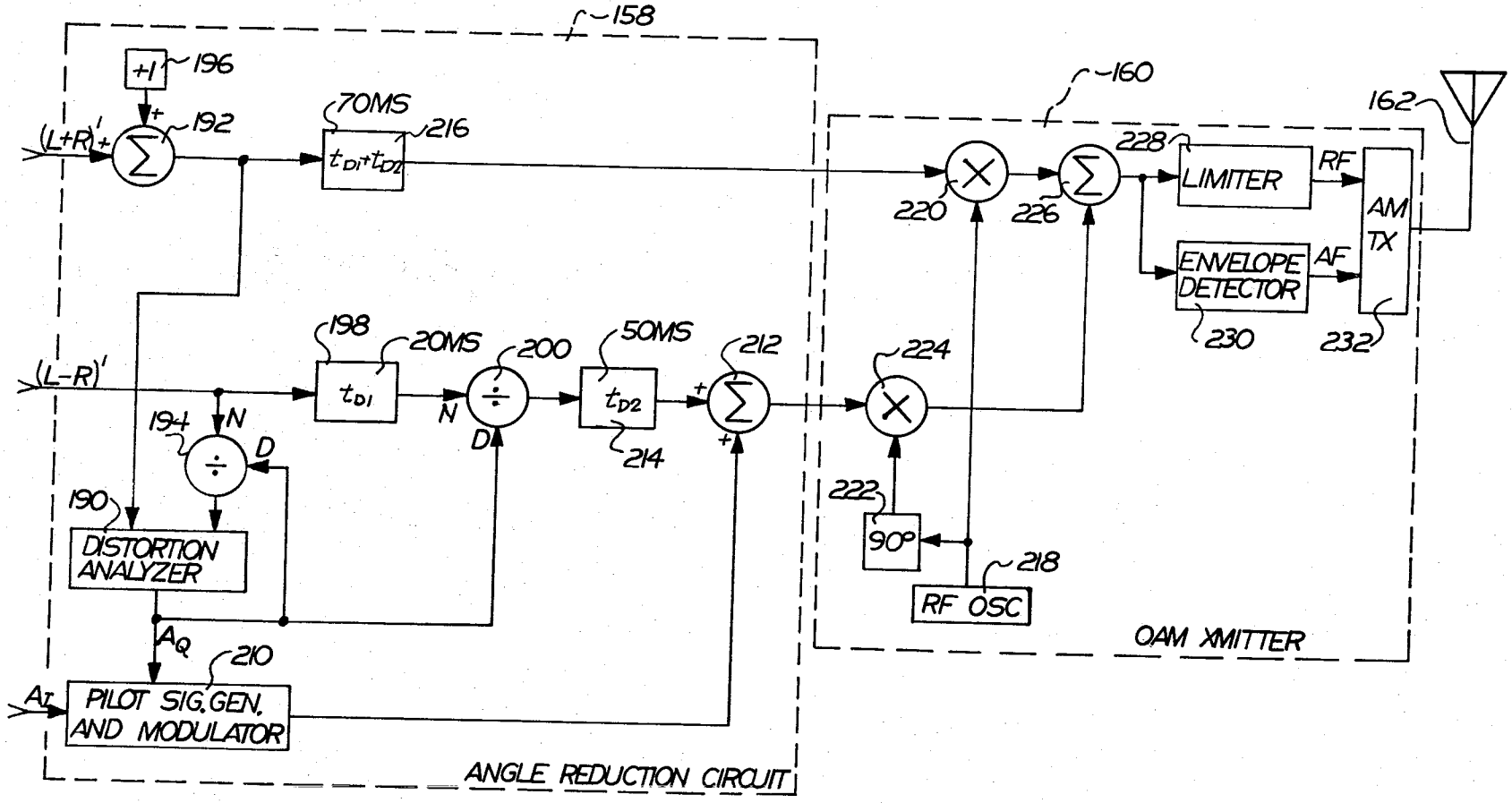

FIGS. 7A and 7B are more detailed diagrams of a modulator/transmitter in accordance with the teachings of the present invention. Two signal sources 150 and 152 provide stereophonically related audio signals L and R which are to be communicated to a receiving station. These signals are provided to a filter network 154 whose purpose is to eliminate the frequencies in the difference (L−R) channel below a predetermined limit (for example, 200 Hz), without affecting the apparent loudness of the bass in the signals as recovered by a subsequent receiver. The L and R signals are then further processed by a limiter/compressor 156, which limits the maximum modulation of the composite modulated signal by applying amplitude constraints to the modulating signals, and which also provides a signal compression function which will be described hereinafter.

An angle reduction circuit 158 responds to the outputs of the limiter/compressor 156, and functions to adjust the amplitude of the quadrature-phase modulating signal in accordance with a distortion estimate, as in the FIG. 3 embodiment. This circuit also generates and modulates a pilot signal in accordance with the gain reduction factor, and then adds the pilot signal to the quadrature-phase modulating signal. A quadrature AM (QAM) transmitter 160 utilizes the in-phase and quadrature-phase modulating signals provided by the angle reduction circuit 158 to modulate in-phase and quadrature-phase carriers, with the modulated carriers then being linearly combined to produce the composite modulated signal. This signal is transmitted via an antenna 162.

Describing these broad blocks now in greater detail, the filter network 154 has a more complicated form than the simple high-pass filter and all-pass filter utilized in the embodiment of FIG. 3, since it also deals with a problem not addressed by the embodiment of FIG. 3. It was found that the elimination of the low frequency signals from the quadrature-phase channel produced a small but noticeable decrease in the loudness of the bass (low frequency) content of the signal as subsequently received and demodulated. Filter network 154 is designed to avoid this loss in bass by adding the bass from the difference signal to the sum signal, with a 90° phase shift. The sum channel therefore contains all of the bass signal which had previously been included in both the sum and difference channels. The phase shift of 90° prevents inadvertent cancellation of the low frequencies of the sum channel with the low frequencies of the difference channel.

The filter network 154 includes a matrix circuit 164 for adding and subtracting the L and R signals to produce the sum (L+R) and difference (L−R) signals. The difference signal is supplied to two filters 166 and 168 which separate it into frequencies below and above a predetermined frequency limit (for example, 200 Hz), respectively. Filter 168 is a high-pass filter which eliminates those frequencies in the difference channel below the frequency limit, where filter 166 is a low-pass filter which eliminates those frequencies which are greater than the frequency limit. As in FIG. 3, the sum signal is processed with an all-pass filter 174 in order to introduce phase shifts which are equivalent to the phase shifts introduced by high-pass filter 168. The signals provided at the outputs of filters 174 and 168 therefore have similar phase shift characteristics. The output of all three filters 166, 168 and 174 are phase-shifted by respective phase shifters 172, 170 and 176. The purpose of these phase shift circuits is to introduce a 90° phase shift between the low frequencies of the difference channel and the low frequencies of the sum channel, without affecting the relative phases of the sum channel and the high frequency portion of the difference channel. Although this could be accomplished by providing a 90° phase shift circuit at the output of low-pass filter 166, it is in practice quite difficult to construct and align a circuit having a phase shift of precisely 90°. It is, on the other hand, relatively simple to construct a circuit which will have a phase shift of 90° with respect to another circuit, and it is this principle which is utilized herein. Thus, circuits 170 and 176 provide corresponding phase shifts of $\phi$, whereas circuit 172 provides a phase shift of $\phi+90°$.

A signal adder 178 adds the outputs of phase shifters 172 and 176 to provide an output signal which corresponds generally to the sum signal, but which has a low frequency content which has been augmented by the low frequencies of the difference channel. A matrix circuit 180 adds and subtracts the output of adder 178 and phase shifter 170 to recover modified left and right signals therefrom. It is these signals which are then supplied to the limiter/compressor circuit 156.

In limiter/compressor circuit 156, divider circuits 182 and 184 are provided for the two audio channels. A limiter control circuit 186 provides a common gain control signal to both of dividers 182 and 184. The limiter control circuit 186 monitors the amplitudes of the L and R signals as well as the amplitudes of (L+R) and (L−R) signals (derived by another matrix circuit 188), and reduces the gains of the L and R signals when necessary to prevent overmodulation of the transmitter. It should be noted that since the gain is uniformly affected in both the left and right channels, this limiting function has no effect on the relative amplitudes of the in-phase and quadrature-phase modulating channels. The limiter/compressor 156 therefore does not affect the phase angles between the L and R vectors of the composite modulated signal.

The limiter control 186 also provides an additional function in order to improve the low amplitude signal-to-noise ratio of the system. When the limiter control circuit 186 senses that the signal level in both the L and R channels has dropped below a predetermined level (corresponding, for example, to 20% modulation), the gain control signal supplied to dividers 182 and 184 is decreased so as to increase the gain of both channels to bring the signals back up to the predetermined modulation level. Since this low level signal compression increases the amplitude of the modulation for low amplitude L and R signals it operates to improve the signal-to-noise ratio in a subsequent stereophonic receiver. Of course, the compression of the L and R signals should be offset by a corresponding expansion of these low amplitude signals in the receiver, and thus it is desirable to transmit a signal to the receiver indicating the existence and extent of any compression of the signals. To this end, the limiter control circuit 186 provides a signal $A_I$ to the pilot signal generator of the angle reduction circuit 158.

The angle reduction circuit 158 is supplied with the modified sum and difference signals from the output of matrix circuit 188, and includes a distortion estimator 190 which will preferably have essentially the same form illustrated in FIGS. 5A and 5B. The two inputs to the distortion estimator 190 are derived from a signal adder circuit 192 and a divider circuit 194. As in the FIG. 3 embodiment, the purpose of adder circuit 192 is to add a DC value supplied by a circuit 196 to the sum signal channel so that the resulting composite modulated signal will contain a DC carrier component which is in-phase with the (L+R) vector component.

Unlike the embodiment illustrated in FIG. 3, the FIG. 7 embodiment does not utilize the output of divider circuit 194 to modulate the quadrature-phase channel of the composite modulated signal. A second divider 200 is instead provided to derive the modulating signal. Both dividers, however, are supplied with the gain control signal derived by the distortion estimator 190. The desireability of including two dividers follows from the presence of a time delay in distortion estimator 190. Because of this delay, which is mainly due to the attack delay previously described, the output of the distortion estimator will not instantaneously reflect a change in the amount of distortion; a circuit such as that illustrated in FIG. 3 will therefore not correct the gain of the quadrature-phase modulating channel rapidly enough to prevent a short period of distortion which is greater than the acceptable limit. The angle reduction circuit 158 of the FIG. 7 embodiment avoids this problem by inserting a delay circuit 198 in the difference channel prior to the second divider circuit 200. This time delay circuit has a time delay which is approximately equal to the attack delay of the distortion estimator 198, so that the (L−R) signal will arrive at the divider 200 approximately coincident with the arrival of the gain control signal derived from that (L−R) value.

As in the previous embodiment, the gain control signal provided at the output of the distortion estimator 190 is also supplied to a pilot signal generator and modulator 210 which generates a low frequency pilot signal, and modulates it in accordance with the gain control signal. This pilot signal modulator also modulates the pilot signal with the compressor signal supplied by the limiter/expander circuit 156. The pilot signal then contains information both relating to the angle between the L and R vectors of the composite modulated signal, and relating to the compression of low level L and R signals. This modulated pilot signal is added into the quadrature-phase channel via an adder circuit 212.

The angle reduction circuit 158 of the FIG. 7 embodiment includes a second time delay 214 between the analog divider circuit 200 and the analog adder circuit 212. This delay is included to account for delays in the pilot recovery loop in a subsequent receiver. If this delay were not included, the inherent time delay in the recovery of the pilot signal by a subsequent receiver would result in the application of the control information embodied in the pilot signal to the audio signal which came a short delay thereafter. By inserting the delay 214 between the divider 200 and the adder circuit 212, however, the pilot signal is advanced in time with respect to the audio signals to which it pertains. This delay circuit 214 has a time delay corresponding to the time delay which will be experienced in the pilot recovery loop in a subsequent receiver, for example, 50 milliseconds.

A third time delay circuit 216 is provided in the (L+R) channel to delay the modified (L+R) signal by an amount corresponding to the total delays of delay circuits 198 and 214. In other words, in the embodiment being disclosed, time delay circuit 216 delays the modified (L+R) signal by approximately 70 milliseconds.

The QAM transmitter 160 may take any conventional form. In the disclosed embodiment, an RF oscillator 218 provides an RF carrier signal to a balanced modulator 220, where it is amplitude modulated by the modified (L+R) signal. The RF carrier signal is also provided to a 90° phase shift circuit 222 which shifts the carrier in phase by 90° to provide a quadrature-phase carrier signal to a second balanced modulator 224. This modulator double-sideband, suppressed carrier (DSB-SC) modulates the quadrature-phase carrier signal in accordance with a quadrature-phase modulating signal, including the modified (L−R) signal and the pilot signal. The two modulated signals provided by modulators 220 and 224 are then additively combined in an adder circuit 226, which provides a low level composite modulated signal at its output.

In the illustrated embodiment, an interface circuit comprised of a limiter 228 and envelope detector 230 is included so as to adapt the composite signal for transmission via a conventional AM transmitter 232. The limiter 228 clips the composite modulated signal provided at the output of adder circuit 226, and provides the resulting low level, constant amplitude RF signal to the RF input of the AM transmitter 232. This RF signal will carry with it the phase information from the low level composite modulated signal. The envelope detector 230, on the other hand, detects the envelope of the composite modulated signal, and provides the resulting audio frequency signal to the audio frequency input of the conventional AM transmitter 232. The AM transmitter amplifies the low level RF signal and amplitude modulates the resulting high level RF signal with the amplitude information provided by the envelope detector 230. A high level composite modulated signal is thus provided which is transmitted by means of an antenna 262.

Figure 8:
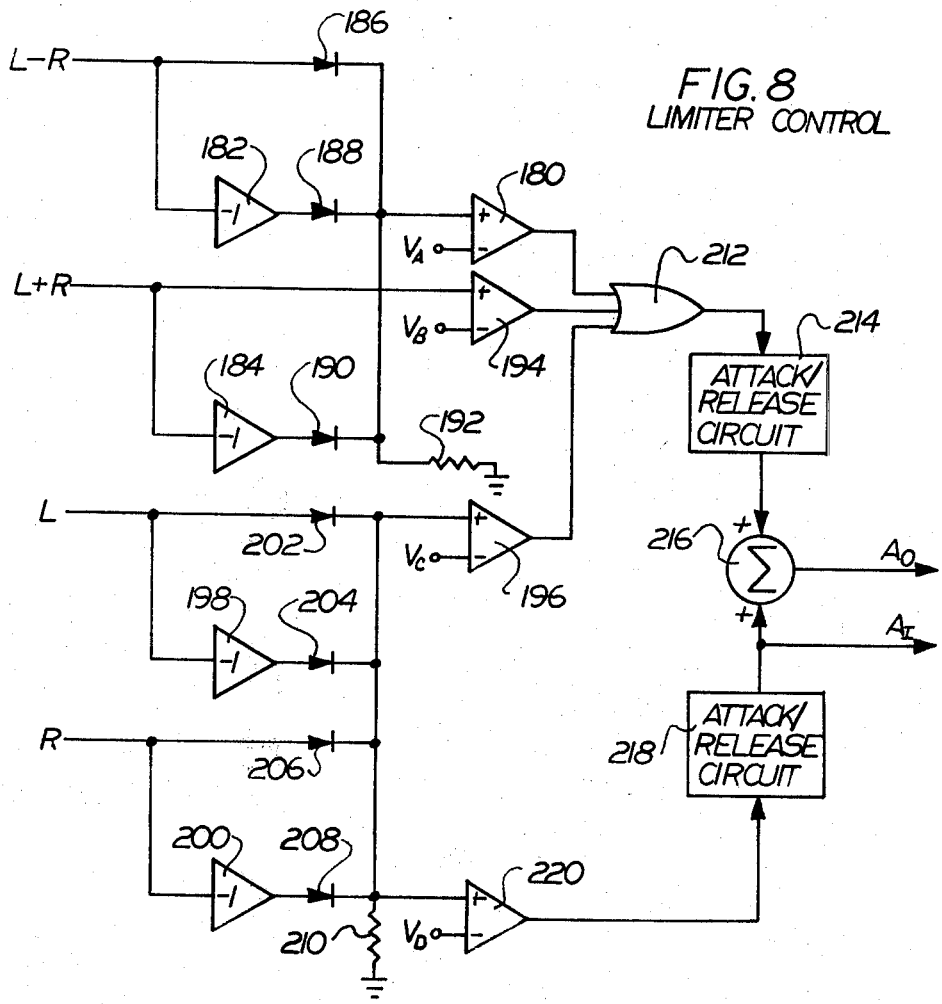
FIG. 8 is a more detailed block diagram of the limiter control circuit of the block diagram of FIG. 7B.

FIG. 8 is a broader block diagram of the limiter control circuit 186 of FIG. 7B. This limiter control circuit applies maximum amplitude constraints to the L and R signals so as to limit modulation of the transmitted signal in the in-phase channel to the presently accepted limits of +125% and −100%. The limiter control further establishes modulation limits of + and −100% in the quadrature-phase channel, and prevents either the left or right channel from individually exceeding a level representative of + or −80% modulation. Of course, limits other than these could instead be used if desired.

The 100% modulation constraints for both in-phase and quadrature-phase channels are established by comparator 180. The negative input to comparator 180 is provided with a reference voltage level $V_A$ representative of 100% modulation. The positive input to comparator 180, on the other hand, is derived by a nonadditive combination of three different signals: The (L−R) signal, an inverted (L−R) signal provided by an analog inverter 182, and an inverted (L+R) signal provided by an analog inverter 184. Nonadditive mixing of these three signals is provided by connecting all three signals to the positive input of comparator 180 through corresponding diodes 186, 188 and 190. A resistor 192 connects the junction of these three diodes to ground so that the input of comparator 180 is never left floating. The positive input to comparator 180 will therefore reflect whichever of these three signals is the greatest in amplitude.

The output of comparator 180 will normally be at a low voltage level. Whenever the positive or negative peaks of the (L−R) signal or the negative peaks of the (L+R) signal have an amplitude greater than the 100% modulation reference signal $V_A$, however, the comparator output will shift to a high level. This will trigger L and R gain reduction through a circuit which will be described hereinafter.

A comparator 194 establishes the +125% modulation constraint for the in-phase channel. This comparator has a signal level representative of +125% modulation applied to its negative input, and the (L+R) signal directly supplied to its positive input. The output of comparator 194 will therefore go to a high voltage level whenever the positive peaks of the (L+R) signal exceed the level representative of 125% modulation. Again, this will trigger L and R gain reduction.

A third comparator 196 establishes the + and −80% modulation constraints for the individual L and R channels. The negative input of this comparator is again provided with a reference voltage, in this case a voltage $V_C$ indicative of positive 80% modulation. The positive input to comparator 196, however, is derived by a nonadditive mixing of four signals: The L signal, an inverted L signal derived from an analog inverter 198, the R signal, and an inverted R signal derived by a second analog inverter 200. Nonadditive mixing is again achieved by means of diodes, in this case four diodes 202, 204, 206, and 208. Also, a resistor 210 again connects the junction of the diodes to ground. The output of comparator 196 will normally be at a low voltage level and will shift to a high voltage level whenever the positive or negative peaks of the L or R signal exceeds the reference level $V_C$. This will again trigger gain reduction in the L and R channels.

The outputs of comparators 180, 194 and 196 are logically "ORed" together by means of a three input OR gate 212. Consequently, the output of OR gate 212 will shift from a low logic level to a high logic level whenever any of the modulation constraints represented by comparators 180, 194, and 196 has been exceeded. The output of OR gate 212 is connected to an attack/release circuit 214 which generates a gain control signal in response thereto. This attack/release circuit may have a form similar to the attack/release circuit utilized in the distortion estimator, described with particular references to FIG. 6. This attack/release circuit, however, lacks the clipping circuit 142 utilized in the attack/release circuit illustrated in FIG. 6, and has a much more rapid attack time than that circuit. Preferably, attack/release circuit 214 has an attack time on the order of 10 microseconds, for example.

The gain control signal provided at the output of attack/release circuit 214 is directed to a signal adder circuit 216 and is there additively combined with a second gain control signal provided by a second attack/release circuit 218. The resulting sum signal is directed to the denominator input of dividers 182 and 184 (FIG. 7A) to control the gain of the L and R signals.

The attack/release circuit 218 operates in conjunction with a comparator 220 to provide compression of low level signals. Thus, comparator 220 has its negative input connected to a reference signal $V_D$ indicative, for example, of +20% modulation, and its positive input connected to the common connection of diodes 202, 204, 206, and 208. The output of comparator 220 will therefore remain at a high logic level as long as any of these signals exceeds the reference level $V_D$. In the event that all four of these signals are below the reference level, however, the output of comparator 220 will shift to a low logic level, and will remain there as long as the condition persists. As will be made clearer hereinafter, the outputs of circuit 218 will normally be at a constant level representative of a denominator value of one. Thus, when the output of circuit 214 has a value of zero (which will always be the case unless modulation limiting is required) the net gain of limiter/compressor 156 will be unity. When any of the modulation constraints established by comparators 180, 194, and 196 are exceeded, however, the output of attack/release circuit 218 will slew positive, producing an increase in the gain control signal $A_Q$ supplied to the dividers and a reduction in the gain of the L and R signals.

Attack/release circuit 218 again has substantially the same form illustrated and described with respect to FIG. 6, in this case also including a clipping circuit such as clipping circuit 142. This clipping circuit will establish the maximum output signal from the attack/release circuit, and as stated above will correspond to a denominator value of one so that the limiter/compressor block 156 of FIG. 7B will have unity gain in the absence of modulation limiting. As long as either the left or right signal exceeds 20% positive or negative modulation, the output of comparator 220 will generally be at a high logic level (except during zero crossings of the L and R signals, of course, when the output of comparator 220 will drop low). This will hold the attack/release circuit 218 at the positive clipping voltage. When the peak amplitudes of both the left and right signals drop below the level $V_D$ necessary to produce 20% positive and negative modulation, however, the output of the comparator 220 will remain at a low level, permitting the attack/release circuit 218 to slowly release from the clipping voltage. As the output of attack/release circuit 218 decays, the output of adder circuit 216 will similarly decay, resulting in an increase in the gain of the L and R signals. When the gain of the signals has increased to the point where the left and right signals again exceed 20% modulation, the output of comparator 220 will again shift to a high level, thereby preventing further increases in the gain of the left and right signals. The output of attack/release circuit 218 will stabilize at the value which increases the gain of the L and R signals back to the 20% modulation level.

Attack/release circuit 218 will also preferably includes a second clipping circuit for preventing the voltage at the output thereof from dropping below a preset level, thereby preventing the compression of the low level signals from exceeding a preselect amount, for example, 12db.

In summary, then, as long as the L and R audio signals do not exceed maximum modulation constraints, the output of OR gate 212 will remain low, and the output of attack/release circuit 214 will remain at essentially a ground voltage level. Further, as long as the audio signals are above the 20% modulation level, the output of comparator 220 will at leat periodically shift to a high level, resulting in attack/release circuit 218 slewing to the positive clipping voltage, representing a gain factor of one. The output $A_o$ will therefore normally reflect a gain factor or 1. In the event that the maximum modulation constraints are exceeded, the output of OR gate 212 will shift to a high level, causing attack/release circuit 214 to slew positive and producing a very rapid decrease in the gain of the signals in the L and R channels. If, the other hand, the audio signals drop below 20% modulation for a significant interval of time, then the output of comparator 220 will remain low and the attack/release circuit 218 will be released. The voltage provided at the output thereof will then begin to decay. The gain in the two audio channels will in that event increase, producing an increase in the gain of the L and R signals to bring them back up to the 20% modulation level.

Figure 9:
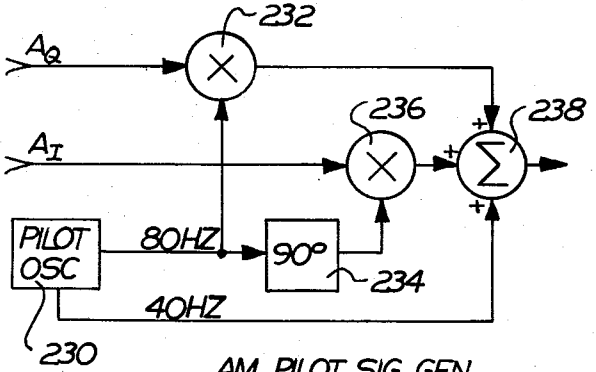
FIG. 9 is a block diagram of an AM pilot signal generator and modulator which could be used in the systems of FIGS. 3 or 7A and 7B.

FIG. 9 illustrates one embodiment of the pilot signal generator and modulator block 210 of FIG. 7A. This circuit amplitude modulates the phase angle and signal expansion information onto two quadrature-phased pilot signals. A pilot oscillator 230 provides a carrier signal having a frequency of 80 Hz, for example, to a balanced modulator 232 and to a 90° phase shifter 234. Modulator 232 modulates the 80 Hz carrier signal by the signal $A_Q$ derived from distortion estimator 190 of FIG. 7B. A second balanced modulator 236 modulates the 90° phase shifted signal supplied by 90° phase shifter 234 with the signal $A_I$ provided by the attack/release circuit 218 of FIG. 8, and which indicates the level of compression being provided by the limiter-compressor circuit. The double sideband signals at the outputs of modulators 232 and 236 are added together in an adder circuit 238, together with a half-frequency signal, also provided by pilot oscillator 230. This one-half frequency (40 Hz) signal, which is in-phase with the 80 Hz signal provided to modulator 232, will be utilized in a subsequent receiver to synchronize an oscillator therein for purposes of demodulating the amplitude modulated pilot signal.

Figure 10:
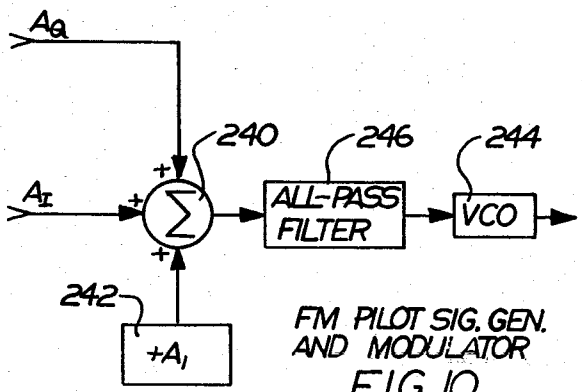
FIG. 10 is a block diagram of an FM pilot signal generator and modulator which could also be used in the systems of FIG. 3 or 7.

FIG. 10 illustrates a second, and presently preferred, embodiment of the pilot signal generator and modulator 210 of FIG. 7B. In this figure, a signal adder circuit 240 adds the phase angle and signal expansion signals $A_Q$ and $A_I$ together with a DC signal $A_1$ provided by a circuit 242. The resulting sum signal is provided to the frequency control input of a conventional voltage controlled oscillator (VCO) 244 through an all-pass filter 246. The purpose of all-pass filter 246 is to minimize overshoot in the output of the low-pass filter which will be used in the FM pilot signal demodulator at the receiver. To accomplish this, all-pass filter 246 is selected to have a time delay versus frequency characteristic which is the complement of that of the low-pass filter in the receiver. The result is that all frequencies will experience a similar time delay, and thus little overshoot will result.

The center frequency (preferably 80 Hz) of the FM pilot provided by the VCO 244 will be set by the sum of the DC value provided by circuit 242, and the DC value of the expansion signal $A_I$ provided by the attack/release circuit 218 of FIG. 8. Reduction in the phase angle between the L and R vectors will be accompanied by an increase in the value of the gain control signal $A_Q$, and will thus result in an increase in the frequency of the pilot signal provided at the output of VCO 244 above the center frequency. Conversely, compression of low level signals will be accompanied by a reduction in the value of the expansion signal $A_I$, resulting in a deviation in the frequency of the signal at the output of VCO 244 below the center frequency. It should be noted that the two events will not take place simultaneously, since compession of the audio signal will only take place when low level signals are present whereas a reduction in the angle between the L and R vectors will characteristically take place only when high amplitude signals are present. It is therefore possible to separate out the two types of information from the FM pilot signal at the receiver by recognizing whether the pilot has deviated in a positive or negative direction from the center frequency.

Both of the embodiments of the pilot signal generator and modulator which have been described will preferably produce pilot signals having frequency spectrums centered on 80Hz. This center frequency has been selected to fall midway between 60 Hz (power line frequency in the United States) and 100 Hz (a harmonic of the 50 Hz power line frequency used in many foreign countries). This pilot signal frequency spectrum may thus extend 20 Hz above or below the center frequency while still avoiding the significant noise components which are synchronous with the power line frequencies.

Figure 11:
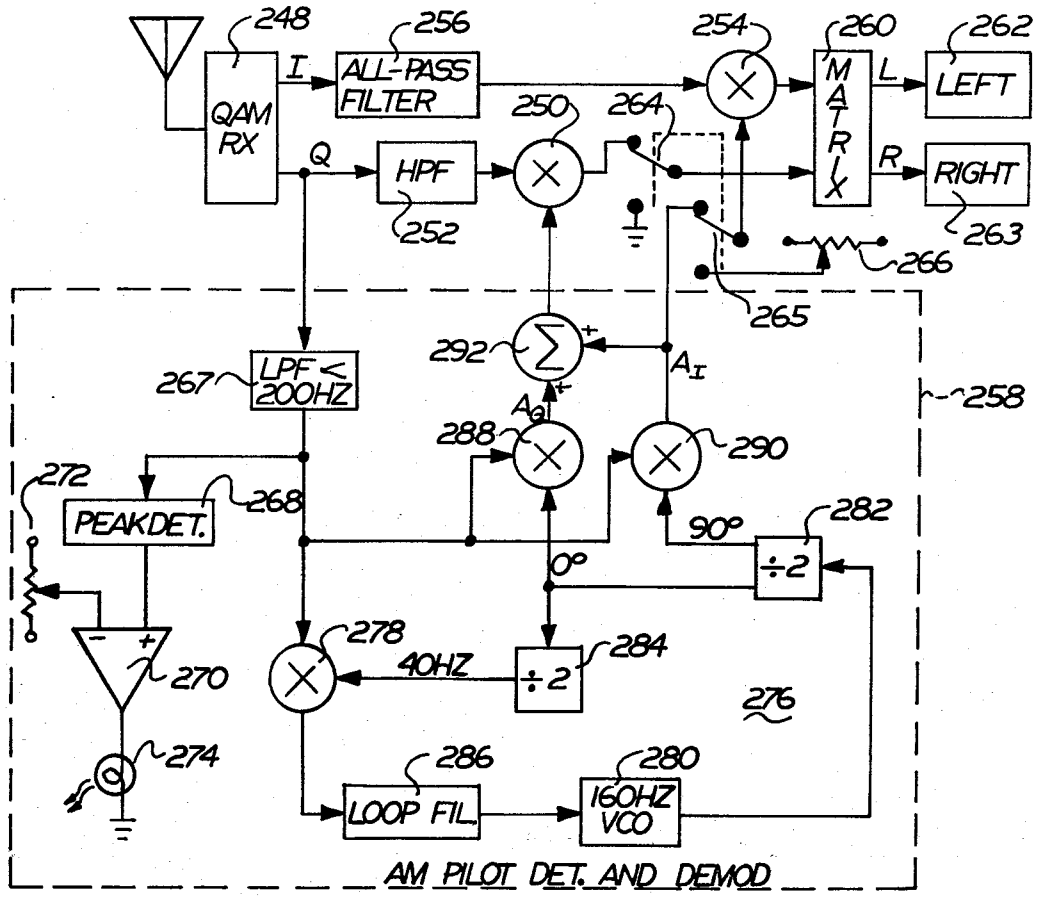
FIG. 11 is a block diagram of a receiver system for receiving the modulated signals generated by the modulator/transmitter system of FIGS. 7A and 7B, including a circuit for demodulating an AM pilot signal.

FIG. 11 illustrates a receiver which is constructed not only to track the varying phase angle between the L and R vectors of the composite modulated signals, but also to make use of the signal expansion information which is modulated on the pilot signal thereof. As in the receiver of FIG. 4, the receiver of FIG. 11 includes a conventional tunable QAM receiver 248 which separately recovers the in-phase and quadrature-phase modulating signals I and Q from the composite modulated signal. The quadrature-phase modulating signal Q is directed to an analog multiplier 250 through a high-pass filter 252, included to eliminate the pilot signals from the channel by removing all frequencies below a certain limit, shown as being 200 Hz. The in-phase modulating signal I, on the other hand, is provided to a second multiplier 254 through an all-pass filter 256 which has the same phase shift characteristics as the high-pass filter 252 in the quadrature channel. The Q output of the QAM receiver 248 is also supplied to an AM pilot detector and demodulator 258 which recovers gain control information for providing gain control signals to multipliers 250 and 254. The gain corrected I and Q signals, corresponding respectively to the sum (L+R) and the difference (L−R) signals are matrixed in a conventional audio matrix 260 to recover the L and R audio signals therefrom. Any desired utilization circuits 262 and 263 may be provided for use of the L and R signals as thus recovered. These circuits will generally include audio amplifiers and associated loudspeakers.

In the receiver of FIG. 11, a DPDT switch is included to permit the listener to switch between stereo and mono modes of reception. In the figure, the two poles 264 and 265 of this switch are shown in the position for stereo reception, where the operation of the receiver is as described above. When receiving a monophonic signal (which, of course, will not include a Q component), the operator may switch the receiver to a mono mode, where poles 264 and 265 are in their alternative positions so as to specifically adapt the receiver to receive monophonic signals. When in the monophonic mode, pole 264 will connect the (L−R) input of matrix 260 to ground, thus preventing the introduction of noise via this route. The other pole 265 will then connect the gain input of multiplier 254 to a fixed gain value set in a potentiometer 266.

In FIG. 11, the pilot detector and demodulator 258 is constructed to detect and demodulate a pilot signal which has been amplitude modulated in two quadrature-phased channels, such as the one provided by the pilot signal generator and modulator of FIG. 9. The pilot detector includes a low-pass filter 267 which filters the Q output of QAM receiver 248 to eliminate all frequencies therefrom which are above the pilot signal in frequency. The output of this low-pass filter is peak detected in a peak detector 268 to provide an indication to a comparator 270 as to whether or not a pilot signal is included in the received signal. If a stereo signal is being received, a pilot signal will be included, and the output of peak detector 268 will exceed a threshold set by a potentiometer 272. The output of comparator 270 will thus go to a high voltage level, illuminating a stereo indicator lamp 274. When receiving monophonic signals (which, of course, will not include a pilot signal), the amplitude of the signal provided at the output of peak detector 268 will be below the threshold set by potentiometer 272, thus the stereo indicator will not be illuminated. A visual indication of the stereo/mono nature of the received signal is thus provided.

In those situations in which it is desired to have the receiver automatically switch between stereo and mono modes of operation, the output of comparator 270 may also be used to control the state of solid state electronic switches, substituted for poles 264 and 265.

The output of low-pass filter 267 is also provided to a pilot signal recovery loop, generally indicated at 276. This pilot signal recovery loop includes a multiplier circuit 278 which multiplies the pilot signals provided at the output of low-pass filter 267 by a 40 Hz signal generated by a 40 Hz oscillator, comprised of a 160 Hz VCO 280, and two divide-by-two circuits 282 and 284. As is conventional practice, the output of the multiplier 278 will be filtered through a loop filter 286, and used to control the frequency of operation of the VCO 280. This pilot recovery loop 276 will synchronize the oscillator 280 with the 40 Hz half-frequency tone included with the pilot signal.

The divide-by-two circuit 282 has two 80 Hz outputs which are in phase quadrature with one another. These two outputs are respectively directed to multipliers 288 and 290, the other inputs of each of which are derived from the output of low-pass filter 267. These multipliers will demodulate the two channels of the pilot signal, with the outputs of multiplier 288 and 290 respectively comprising the signals $A_Q$ and $A_I$ utilized to modulate the in-phase and quadrature-phase channels of the pilot signal.

The recovered $A_I$ signal will be directly used to control the gain of multiplier 254 (when the receiver is in the stereo mode), and will be supplied also to multiplier 250 through a signal adder circuit 292. Thus, as the signal $A_I$ diminishes in amplitude, indicating that the signal is being compressed at the transmitter, the gain of both of the signals in the I and Q channels will be reduced by a corresponding amount.

The recovered $A_Q$ signal, representative of the varying angle between the L and R vectors of the composite modulated signal, will be added to the $A_I$ signal by the signal adder circuit 292 and thus also used to control the gain in the quadrature-phase channel by means of the multiplier 250. Thus, as the signal $A_Q$ increases, indicating a reduction in the angle between the L and R vectors of the composite modulated signal, the gain in the Q channel will be increased to compensate for the reduced amplitude of the quadrature-phase component. Similarly, when the signal $A_Q$ diminishes in amplitude, indicating that the angle between the two vectors is increasing, a decrease in the gain in the quadrature channel will result which exactly mirrors the increase in the amplitude of the quadrature component. The FIG. 11 receiver therefore automatically compensates for both compression of the signal at the transmitter, and for dynamic variations in the phase angle between the L and R vectors in the composite modulated signal.

Figure 12:
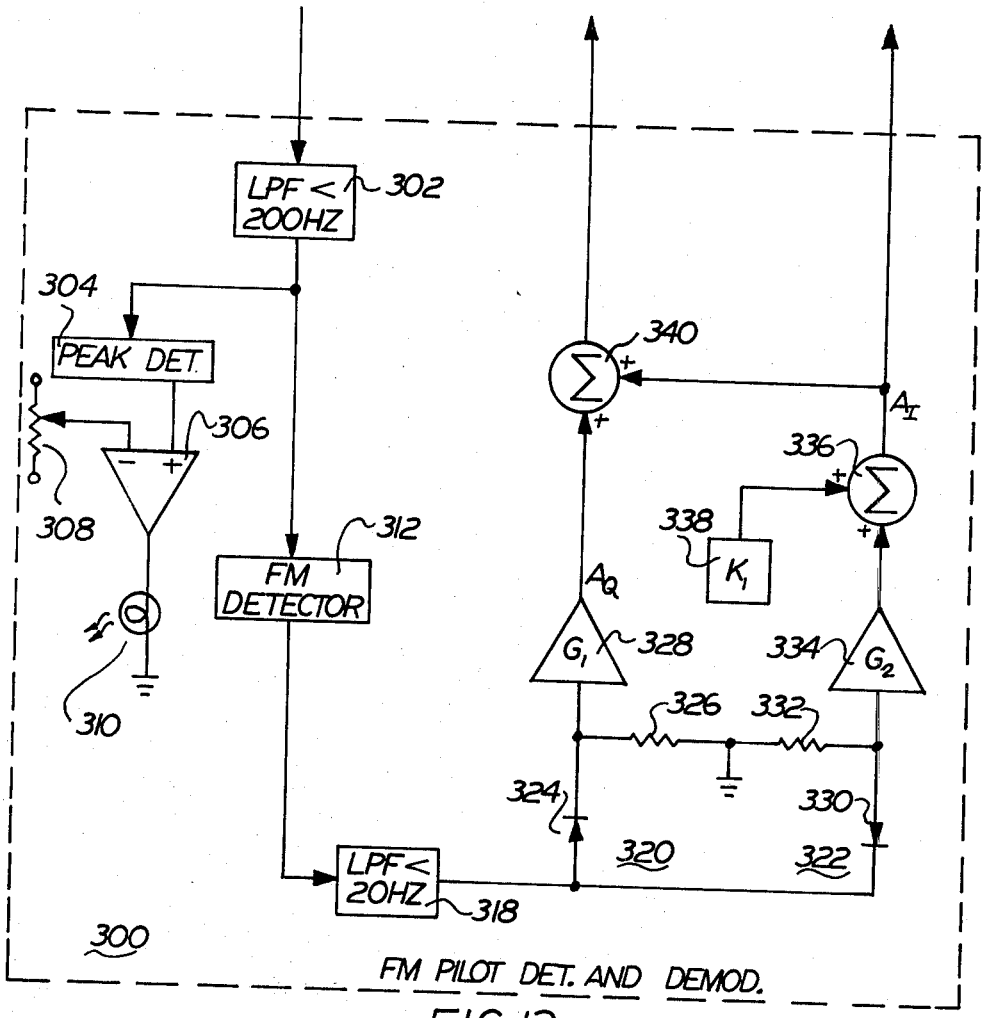
FIG. 12 is a block diagram of a circuit for demodulating an FM pilot signal, which could be alternatively used in the system of FIG. 11.

FIG. 12 illustrates a pilot detector and demodulator 300 which may be substituted for the detector and demodulator 258 of FIG. 11 when an FM pilot is being used instead of an AM pilot. The FM pilot detector and demodulator 300 of FIG. 12 again includes a low-pass filter 302 for eliminating all frequencies above the pilot, thereby separating out the modulated pilot signal from the (L-R) information. Also, a peak detector 304 will again operate in conjunction with a comparator 306, a reference circuit 308, and a stereo indicator light 310 to provide a visual indication that a stereo signal is being received. As before, the output of comparator 306 could be used to provide automatic stereo-mono switching, if desired.

The output of the low-pass filter 302 is also directed to an FM detector 312. This FM detector may take any convenient form, and will preferably utilize a phase-locked-loop in a conventional manner to accomplish the FM demodulation. The output of the FM detector 312 is a signal whose amplitude varies with the frequency of the FM pilot. Preferably, the output thereof will have a ground voltage level when the FM pilot signal is at the center frequency. Deviations of the pilot above the center frequency will then produce a positive output, whereas frequency deviations below the center frequency will produce a corresponding negative voltage at the output of the detector.

A low-pass filter 318 filters the frequency indication signal so as to remove any beat frequencies at harmonics of the pilot signal. As stated earlier, overshoot from this filter is minimized due to the inclusion of the all-pass filter 246 in the pilot signal generator and modulator of FIG. 10.

To separate the phase angle information from the signal expansion information, the output of low-pass filter 318 is directed to a positive peak rectifier 320 and a negative peak rectifier 322. Positive peak rectifier 320, comprised of a diode 324 and a resistor 326, provides all positive signals at the output of low-pass filter 318 to a gain circuit 328 having a gain $G_1$. Since these positive signals represent positive frequency deviations of the FM pilot, they carry all of the phase angle information. Negative peak rectifier 322, on the other hand, comprised of a diode 330 and a resistor 332, provides only the negative going portions of the output of low-pass filter 318 to a second amplifier circuit 334. This amplifier has a gain $G_2$ which may be different from the gain $G_1$ of amplifier 328. The output of amplifier 328 is thus a positive going signal corresponding to the phase angle signal $A_Q$, whereas the output of amplifier 334 is a negative going signal corresponding to the expansion signal $A_I$ minus a DC value. A signal adding circuit 336 restores a DC value, derived from circuit 338, to the signal at the output of amplifier 334. The output of adder 336 will then correspond to the gain term $A_I$.

The recovered $A_I$ signal is directly supplied to the multiplier 254 for the I channel through the pole 265 of the stereo/mono switch, and is indirectly supplied to the multiplier 250 for the Q channel through signal adder 340. When no compression of the signal is being provided at the transmitter, there will be no negative deviations of the carrier from the center frequency and the output of the amplifier 334 will remain at a ground value. The output of signal adder 336 will therefore have the DC value established by the circuit 338, which may be considered to represent a gain factor of 1. Compression of the audio signals at the transmitter will result in a netative deviation of the pilot from the center frequency, producing a negative going output from the amplifier 334. This negative signal will result in a decrease in the recovered signal $A_I$, and a resulting decrease in the gain of the audio signals which will exactly mirror the gain increase provided in the transmitter.

The output of amplifier 328, representing the term $A_Q$, is used as in the FIG. 11 embodiment to directly control the gain of the quadrature channel via signal adder 340. The gain in the Q channel will thus again be automatically controlled in accordance with the changing phase angle between the L and R vectors of the composite modulated signal.

Two of the filters in the receivers of FIGS. 11 and 12 may be eliminated by removing the pilot signal by signal cancellation techniques, rather than filtering. Thus, FM detector 312 will conveniently include a VCO whose output is locked in phase with the input signal. More specifically, the phase of the output of the VCO included in the FM detector 312 may be made to closely follow the phase variations of the pilot signal. By appropriate signal processing of the output of the VCO then, a signal can be generated which will exactly cancel the pilot signal when the two are added together.

Figure 13:
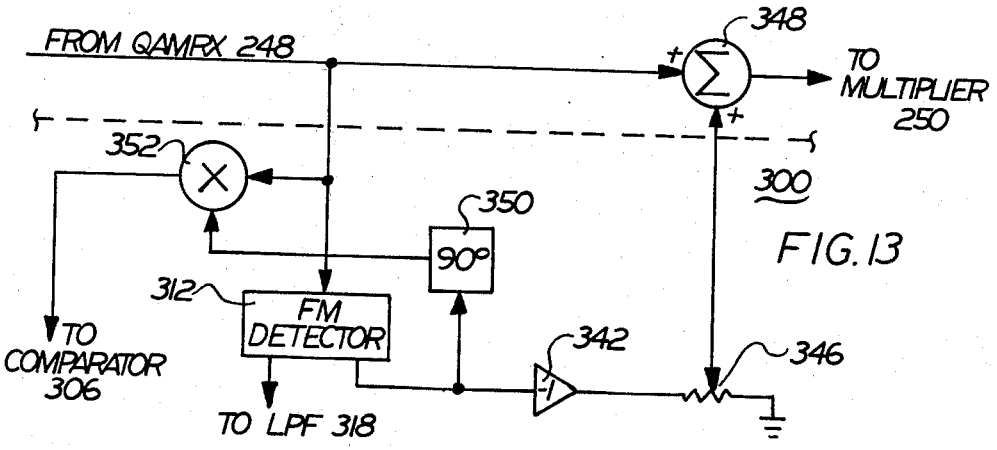
FIG. 13 is a block diagram of an alternative embodiment of a portion of the receiver system of FIGS. 11 and 12.

A circuit for accomplishing this is generally illustrated in FIG. 13. The FM detector 312 utilized in this event includes a sinewave VCO so that the output thereof may be easily used for cancellation of the pilot signal, which also has a sinusoidal waveform. The output in the VCO in the FM detector 312 is provided to an analog inverter 342 which inverts it so as to provide a signal which is in phase opposition with the pilot signal.

In order to cancel the pilot signal, it is necessary to adjust the amplitude of the signal at the output of inverter 342 to be the same as the amplitude of the pilot signal. The amplitude of the pilot signal in the Q output of receiver 248 will, however, remain substantially constant since the QAM receiver will conventionally include an AGC (automatic gain control) circuit. The amplitude of the inverted VCO output is adjusted to this expected level of the pilot by means of a potentiometer 346. The output of the potentiometer 346 will therefore comprise a signal which will be essentially identical with the pilot signal, but which is in phase opposition with it. Cancellation of the pilot signal from the quadrature-phase modulating signal on the Q output of receiver 248 may therefore be accomplished by simply adding the signal derived from the potentiometer 346 into the Q signal with a signal adder 348. This eliminates the need for both of filters 252 and 256, thus simplifying the receiver by permitting a larger portion of it to be integrated into one or more integrated circuits without extensive need for additional discrete components.

In order for the circuit thus far described to operate properly, it is desirable that low-pass filter 302 included in the circuit of FIG. 12 also be eliminated. This is because filter 302 will introduce phase shifts in the subsequent cancellation signal provided at the wiper arm of the potentiometer 346. Since the cancellation signal would then not exactly mirror the pilot signal, however, cancellation would not be as effective. In the circuitry of FIG. 13, the need for a low-pass filter such as filter 302 is eliminated by designing the loop filter in the phase-locked-loop associated with the FM detector to reject extraneous frequencies.

The elimination of low-pass filter 302 necessitates some revision in the circuitry for providing the stereo indicator. In FIG. 13, the signal provided to comparator 306 is derived by phase shifting the VCO output with a circuit 350 which provides a 90° phase shift at the FM center frequency of 80 Hz, and multiplying the resulting phase shifted signal by the quadrature-phase modulating signal Q in a multiplier 352. If an FM pilot signal is present, the output of multiplier 352 will include a DC component. This DC component is detected by a comparator 306 operating in conjunction with a reference potentiometer 308, as in the past.

The method which has been described of dynamically varying the phase angle between the L and R vectors of a composite modulated signal may also be advantageously employed in such other systems as the so-called "independent sideband" (ISB) systems. In one ISB system, the L and R signals are matrixed to form sum (L+R) and difference (L−R) signals. These (L+R) and (L−R) signals are shifted in phase by 90° with respect to one another, and then modulated onto quadrature-phased carriers in a conventional QAM transmitter. Due to the 90° phase shift between the (L+R) and (L−R) signals, the resulting composite modulated signal has the L information carried entirely in one sideband thereof and the R information carried entirely in the other sideband. In this type of ISB system, which may be referred to pure ISB, existence of a quadrature-phased component in the modulated signal again causes the envelope to be unacceptably distorted from the desired compatible form. It has thus been necessary in the past to predistort the composite modulated signal into a format which is more compatible for reception in conventional monophonic receivers.

The need for predistorting the ISB composite modulated signal may be eliminated by dynamically varying the amplitude of the quadrature-phased component in the manner which has been described above. A transmitter system utilizing this concept may have the same form as illustrated in FIG. 7A–7B, except that means will be provided prior to limiter/compressor 156 for phase shifting the (L+R) and (L−R) signals by 90° with respect to one another. This may be accomplished in any number of ways. Phase shifter 170, for example, could be constructed to provide a phase shift of $\phi+90°$ across the audio frequency band. Alternatively, separate phase shifters could be provided in each channel immediately prior to matrix 180 or immediately following matrix 164 to shift the (L+R) and (L−R) signals by $\phi$ and $\phi+90°$, respectively.

A radio receiver for receiving and demodulating a signal as transmitted by the above described transmitter would have essentially the form illustrated in FIG. 11 or 12, depending again upon whether an AM or FM pilot were used. In addition, phase shifters would be included to offset the phase shifts in the transmitter and thus restore the recovered (L+R) and (L−R) signals to their original phase relationship. For the transmitter phase shift examples described above, a corresponding radio receiver would have phase shifters in the (L+R) and (L−R) signal paths providing phase shifts of $\phi$ and $\phi-90°$, respectively.

Reduction of the phase angle between the L and R modulated phase components of the ISB composite modulated signal causes a loss in the otherwise total independence of the upper and lower sidebands. Thus, as the phase angle is reduced from 90° to 30°, the information from each sideband blends in increasing amounts into the other sideband. Each sideband will, however, still predominantly carry information from only one of the two audio signals.

This modified ISB system has the further advantage that, when the L and R audio signals are in-phase with one another, the distortion in the envelope of the composite modulated signal will be smaller than in the previously described modified QAM system. The phase angle between the L and R components of the composite modulated signal will thus have a larger average value than in the modified QAM system, resulting in a somewhat improved SNR in stereophonic receivers.

Although the invention has been described with respect to a preferred embodiment, it will be appreciated that various rearrangement and alterations of the parts may be made without departing from the spirit and scope of the present invention, as defined in the appended claims.

What is claimed is:

1. A system for communicating at least first and second signals from a first location to a second location, comprising:

means at said first location for modulating a carrier signal in accordance with said at least first and second signals to provide a modulated signal including a carrier component and at least two phase components, with the amplitude of each of said phase components being modulated in accordance with a corresponding one of said at least first and second signals, and with the phase angle between said phase components being dynamically varied in functional dependence upon characteristics of said at least first and second signals;

means for communicating said modulated signal from said first location to said second location;

means at said second location for demodulating said modulated signal to recover said at least first and second signals therefrom.

2. A modulator for modulating at least first and second signals onto a carrier signal to produce a modulated signal to be communicated to a plurality of demodulators, including first demodulators operative to separately recover said at least first and second signals from said modulated signal, and second demodulators operative to recover only a signal corresponding to the envelope of said modulated signal, said modulated signal producing distortion in said second demodulators to the extent that said envelope differs from the sum of said at least first and second signals, said modulator comprising:

means for modulating a carrier signal in accordance with said at least first and second signals to provide a modulated signal including a carrier component and at least two phase components, with the amplitude of each said phase component being modulated in accordance with a corresponding one of said at least first and second signals, said modulator means being controllable to vary the phase angle between said phase components, means for determining the amount of distortion which said modulated signal will produce in said second demodulators and for controlling said modulating means to dynamically adjust said phase angle so as to permit said phase angle to be as large as possible without causing said distortion to exceed predetermined constraints.

3. Apparatus for modulating a carrier signal to produce a modulated signal including a carrier component and at least two modulated phase components, said modulated signal to be communicated to first and second types of demodulators, where a performance characteristic of said first type of demodulators improves as the phase angle between said phase components increases and a performance characteristic of said second type of demodulators deteriorates as said phase angle increases, said apparatus comprising:

means for providing said modulated signal, said means being controllable to vary said phase angle between said modulated phase components; and means for controlling said providing means to dynamically vary said phase angle in accordance with a dynamic determination of the extent of deterioration of said performance characteristic of said second type of demodulator.

4. Apparatus comprising:

means for providing a modulated signal including first and second modulated phase components having a varying phase angle therebetween, and for providing a phase angle signal which varies in accordance with said varying phase angle;

means for communicating said modulated signal and said phase signal provided by said providing means to a demodulating means; and demodulating means for demodulating third and fourth phase components of said modulated signal and responsive to said phase signal for controlling the phase angle between said third and fourth phase components demodulated by said means;

whereby said phase signal provided by said providing means automatically adjusts said phase angle between said third and fourth phase components to correspond to said phase angle between said first and second phase components so that said third and fourth phase components demodulated by said demodulating means correspond substantially to said first and second modulated phase components.

5. A modulator for modulating one carrier signal in accordance with in-phase and quadrature-phase modulating signals, respectively, to provide a composite modulated signal to be communicated to first and second types of demodulators, wherein said first type of demodulator is operative to separately recover said in-phase and quadrature-phase modulating signals, and said second type of demodulator is operative to recover only a signal corresponding to the envelope of said composite modulated signal, it being desired that said signal recovered by said second type of demodulator be distorted by no more than preselected amount from one of said modulating signal, said modulator comprising:

means for providing said in-phase and quadrature-phase modulating signals;

means responsive to a control signal for adjusting the relative gains of said in-phase and quadrature-phase modulating signal;

means for modulating said at least one carrier signal in accordance with said gain adjusted in-phase and quadrature-phased modulating signals to produce a composite modulated signal; and, means for dynamically determining the extent to which the envelope of said composite modulated signal is distorted from one of said modulating signals, and for providing a control signal to said gain adjusting means to dynamically adjust the relative gains of said in-phase and quadrature-phase modulating signals to be such that said distortion does not exceed said preselected amount.

6. A modulator for modulating one carrier signal in accordance with in-phase and quadrature-phase modulating signals, respectively, to provide a composite modulated signal to be communicated to first and second types of demodulators, wherein said first type of demodulator is operative to separately recover said in-phase and quadrature-phase modulating signals, and said second type of demodulator is operative to recover only a signal corresponding to the envelope of said composite modulated signal, it being desired that said signal recovered by said second type of demodulator be distorted by no more than a preselected amount from one of said modulating signals, said modulator comprising:

means for providing said in-phase and quadrature-phase modulating signals;

means responsive to a control signal for adjusting the relative gains of said in-phase and quadrature-phase modulating signals;

means for modulating said at least one carrier signal in accordance with said gain adjusted in-phase and quadrature-phased modulating signals to produce a composite modulated signal;

means for dynamically determining the extent to which the envelope of said composite modulated signal is distorted from one of said modulating signals, and for providing a control signal to said gain adjusting means to dynamically adjust the relative gains of said in-phase and quadrature-phase modulating signals to be such that said distortion does not exceed said preselected amount;

means for providing a pilot signal;

means for modulating said pilot signal in accordance with a signal which varies with the dynamic variations in said relative gain of said modulating signals; and means for communicating said modulated pilot signal along with said in-phase and quadrature-phase modulating signals so as to provide a dynamic indication of said gain to said demodulators.

7. Apparatus as set forth in claim 6, and further including means for retarding said gain adjusted in-phase and quadrature-phase modulating signals in time relative to said pilot signal by an amount corresponding to the amount of time required at said first type of demodulator to recover and demodulate said pilot signal.

8. Apparatus as set forth in claim 6 wherein said pilot signal has a frequency spectrum within the frequency range from 60 Hz to 100 Hz.

9. Apparatus as set forth in claim 6, wherein said means for transmitting said pilot signal comprises first filter means for filtering said quadrature-phase modulating signal so as to provide a first filtered signal having all signals eliminated therefrom which fall within the frequency spectrum of said pilot signal, and means for additively combining said pilot signal and said first filtered signal and for providing the resulting signal to said carrier modulating means so that said pilot signal is modulated onto said second carrier along with said quadrature-phase modulating signal.

10. Apparatus as set forth in claim 9, and further comprising second filter means for filtering said quadrature-phase modulating signal to provide a second filtered signal including only those portions of said quadrature-phase modulating signal which are within the frequency spectrum of said pilot signal and means for combining said second filtered signal with said in-phase modulating signal so as to provide an augmented in-phase signal, said augmented signal being provided to said carrier modulating means for modulating said first carrier, whereby those signals eliminated from said quadrature-phase modulating signal by said first filter means are combined with said in-phase modulated signal.

11. Apparatus as set forth in claim 10 wherein said means for combining said second filtered signal with said in-phase modulating signal includes means for phase shifting said second filtered signal and said in-phase modulating signal by 90° relative to one another, and means for adding the resulting signals to one another to provide said augmented in-phase modulating signal.

12. Apparatus as set forth in claim 6, wherein said modulating means comprises means for frequency modulating said pilot signal in accordance with said signal which varies with the dynamic variations in relative gain of said in-phase and quadrature-phase modulating signal, and means for processing said frequency modulated pilot signal, said processing means having a time delay versus frequency characteristic which is the complement of that of a circuit used in the said first type of demodulator to process and pilot signal.

13. Apparatus as set forth in claim 12, and further comprising means for providing a control signal to be transmitted to said demodulators, said control signal having a fixed value during those intervals in which the gain of said quadrature-phase modulating signal is below its maximum value, and wherein said means for frequency modulating said pilot signal includes means for causing said pilot signal to deviate in frequency in a first direction with respect to a center frequency in accordance with deviations in the gain of said quadrature-phase modulating signal below said maximum value, and to deviate in frequency in a second direction with respect to said center frequency in accordance with deviations in said control signal from said fixed value, whereby a single frequency modulated pilot signal is used to communicate two types of control information to said demodulators.

14. Apparatus as set forth in claim 13 wherein said means for providing said in-phase and quadrature-phase modulating signals comprises means for processing said signals, and wherein said control signal providing means provides a said control signal which varies with the extent of said processing.

15. Apparatus as set forth in claim 5, wherein said means for providing said in-phase and quadrature-phase modulating signals comprises means for providing first and second audio signals, means for adjusting the amplitudes of said first and second audio signals to provide first and second amplitude adjusted audio signals, and means for adding said amplitude adjusted signals to provide a sum signal for use as said in-phase modulating signal and for subtracting said amplitude adjusted signals to provide a difference signal for use as said quadrature-phase modulating signal.

16. Apparatus as set forth in claim 15, wherein said amplitude adjusting means includes means for limiting the maximum amplitudes of said first and second audio signals in accordance with predetermined maximum modulation constraints, and means for compressing low level said first and second audio signals so as to improve reception of said signals at said demodulators.

17. Apparatus as set forth in claim 16, wherein said amplitude compressing means includes means for providing an expansion signal indicative of the extent of said compression of said audio signals, and wherein said apparatus further comprises means for transmitting said expansion signal along with said in-phase and quadrature-phase modulating signals so as to provide a dynamic indication to said demodulators of the extent of said compression.

18. Apparatus as set forth in claim 17, wherein said means for transmitting said expansion signal comprises means for frequency modulating a pilot signal in accordance with both said expansion signal and the dynamic variations in gain of said quadrature-phase modulating signal, and means for transmitting said modulated pilot signal along with said in-phase and quadrature-phase modulating signals.

19. Apparatus as set forth in claim 18, wherein said expansion signal has a substantially fixed value during those intervals in which the gain of said quadrature-phase modulating signal is below its maximum value, and wherein said means for frequency modulating said pilot signal includes means for causing said pilot signal to deviate in frequency in a first direction with respect to a center frequency in accordance with deviations in the gain of said quadrature-phase modulating signal below said maximum value, and to deviate in frequency in a second direction in accordance with deviations in said expansion signal from said fixed value, whereby a single frequency modulated pilot signal carries both said expansion signal and said signal which varies with the dynamic variations in gain of said quadrature-phase modulating signal.

20. Apparatus as set forth in claim 5, wherein said distortion determining means comprises means for deriving an envelope signal corresponding to the envelope of said composite modulated signal, means for subtracting one of said modulating signals from said envelope signal to produce a distortion signal representing the difference between said signals, and means for providing an indication whenever said distortion signal indicates that said distortion has exceeded selected limits, and means for controlling said gain adjusting means in accordance with said indication.

21. A modulator for modulating one carrier signal in accordance with in-phase and quadrature-phase modulating signals, respectively, to provide a composite modulated signal to be communicated to first and second types of demodulators, wherein said first type of demodulator is operative to separately recover said in-phase and quadrature-phase modulating signals, and said second type of demodulator is operative to recover only a signal corresponding to the envelope of said composite modulated signal, it being desired that said signal recovered by said second type of demodulator be distorted by no more than a preselected amount from one of said modulating signals, said modulator comprising:

means for providing said in-phase and quadrature-phase modulating signals;

means responsive to a control signal for adjusting the relative gains of said in-phase and quadrature-phase modulating signals;

means for modulating said at least one carrier signal in accordance with said gain adjusted in-phase and quadrature-phased modulating signals to produce a composite modulated signal; and, means for dynamically determining the extent to which the envelope of said composite modulated signal is distorted from one of said modulating signals, and for providing a control signal to said gain adjusting means to dynamically adjust the relative gains of said in-phase and quadrature-phase modulating signals to be such that said distortion does not exceed said preselected amount;

wherein said distortion determining means comprises means for deriving an envelope signal corresponding to the envelope of said composite modulated signal, means for subtracting one of said modulating signals from said envelope signal to produce a distortion signal representing the difference between said signals, means for providing an indication whenever said distortion signal indicates that said distortion has exceeded selected limits, and means for controlling said gain adjusting means in accordance with said indication; and wherein said indication providing means comprises means for providing a second distortion signal having a DC value which varies with the energy content of said first distortion signal, and a limit signal indicative of said selected distortion limit, means for normalizing a selected one of said limit signal or said second distortion signal and means for comparing said limit signal and said second distortion signal as normalized to provide said indication.

22. A modulator for generating a composite modulated signal having a first signal predominantly carried in one sideband thereof and a second signal predominantly carried in the other sideband thereof, with the envelope of said composite modulated signal corresponding to the sum of said first and second signals with predetermined limits, comprising:

means for providing said first and second signals;

means for providing a third signal indicative of the sum of said first and second signals and a fourth signal indicative of the difference of said first and second signals;

means for phase shifting said third and fourth signal relative to one another by substantially 90°;

means for adjusting the relative gains of said phase shifted third and fourth signals in accordance with a value of a control signal;

means for modulating each of said gain adjusted third and fourth signals onto a corresponding one of two quadrature-phased carriers, and for combining the resulting modulated carriers to provide said composite modulated signal; and means for dynamically determining the extent to which the envelope of said composite modulated signal is distorted from the sum of said first and second signals and for providing a control signal to said gain adjusting means, said control signal being dynamically adjusted to be such that said distortion does not exceed predetermined limits.

23. Apparatus for demodulating a composite modulated signal including at least first and second phase components having a varying phase angle therebetween, said composite modulated signal also including a pilot signal having a characteristic which varies as the phase angle between said phase components, comprising:

first means for demodulating a signal having first and second phase components, said means having a characteristic which is controllable to provide optimum demodulation of a signal having a phase angle between said phase components which varies with said characteristic;

means for providing said composite modulated signal to said first means, and means for controlling said first means in accordance with said varying characteristic of said pilot signal, whereby said apparatus is automatically and dynamically adapted to said varying phase angle to provide optimum demodulation of said composite modulated signal.

24. An AM stereo modulator comprising means for providing first and second signals, and means responsive to said first and second signals to provide two phase displaced AM carrier components with the amplitude of each of said AM components being modulated in accordance with a corresponding one of said first and second signals, and with the phase displacement between said AM components being varied in dependence upon characteristics of said first and second signals.

25. An AM stereo modulator as set forth in claim 24, wherein said means for providing said components includes means for providing said components with a phase displacement therebetween which tends towards 90° but is reduced as necessary to prevent the envelope of the vector sum of said components from differing from the sum of said first and second signals by more than a predetermined amount.

26. An AM stereo modulator as set forth in claim 24, wherein said means for providing said at least two AM carrier components includes means for providing a pilot signal having a characteristic which varies in a known dependence upon said phase angle.

27. An AM stereo modulator as set forth in claim 24, wherein said means for providing said first and second signals includes means for phase shifting said signals relative to one another by substantially 90° at all frequencies within the frequency band of said first and second signals, and for providing the resulting relatively phase shifted signals to said AM carrier component providing means for amplitude modulating respective ones of said AM carrier components whereby each of said first and second signals will be predominantly carried on a corresponding one of the upper and lower sidebands of the vector sum of said at least two AM carrier components, but where the content of said sidebands will be blended in accordance with said varying phase displacement.

28. An AM stereo modulator as set forth in claim 24, wherein said means for providing said at least two AM components includes means for providing said components wherein the gain of said AM components varies as an inverse function of the cosine of one half of said phase angle.

29. An AM stereo modulator comprising means for providing in-phase and quadrature-phase modulating signals, means for varying the relative gains of said in-phase and quadrature-phase modulating signals in accordance with at least one characteristic of said signals, and QAM modulating means for modulating the in-phase and quadrature-phase components of a QAM signal with said relative gain varied in-phase and quadrature-phase modulating signals, respectively.

30. An AM stereo modulator comprising audio matrix means for matrixing left and right audio signals to derive sum and difference signals therefrom, means for varying the gain of said difference signal in accordance with variations in at least a selected characteristic of said left and right audio signals, and means for applying said sum and gain varied difference signal to the in-phase and quadrature-phase modulating inputs, respectively, of a quadrature amplitude modulator.

31. An AM-ISB modulator comprising means for providing first and second signals, means responsive to said first and second signals to provide a modulated signal including upper and lower AM sidebands, each of said sidebands being amplitude modulated predominantly by a corresponding one of said first and second signals, but also by the other of said signals to an extent which varies in accordance with the amount by which the envelope of said modulated signal differs from the sum of said first and second signals.

32. An AM-ISB modulator as set forth in claim 31, wherein said means responsive to said first and second signals comprises means for providing a said modulated signal wherein the extent of said modulation of each of said sidebands by the other of said signals tends towards zero, but is increased as necessary to prevent the envelope of said modulated signal from differing from the sum of said first and second signals by more than a predetermined amount.

33. An AM-ISB modulator as set forth in claim 31, wherein said means for providing said modulated signal includes means for providing a pilot signal having a characteristic which varies in a known dependence upon the extent of said modulation of each of said sidebands by the other of said signals.

34. A method of providing a stereo AM signal compatible for reception by a receiver employing an envelope detector to recover a monaural signal, comprising the steps of providing first and second audio frequency signals, generating a QAM signal from said first and second signals wherein the in-phase component of said QAM signal is amplitude modulated by the sum of said first and second signals and the quadrature-phase component of said QAM signal is amplitude modulated by the difference between said first and second signals, and varying the gain of said quadrature-phase component as necessary to prevent the envelope of said QAM signal from becoming distorted from a monaural form by more than a preselected amount.

35. A method as set forth in claim 34, wherein said step of varying the gain of modulation of said quadrature-phase component includes the steps of determining the extent to which the envelope of said QAM signal differs from said monaural form, permitting the gain of said quadrature-phase component to tend towards equality with the gain of said in-phase component, and reducing the gain of said quadrature-phase component when necessary to prevent the determined difference from exceeding predetermined constraints.

36. A method as set forth in claim 34 wherein said step of generating said QAM signal includes the steps of generating a said QAM signal including a pilot signal, and varying a characteristic of said pilot signal in a known dependence upon the varying gain of said quadrature-phase component.

37. A method as set forth in claim 34, wherein said step of generating said QAM signal includes the step of providing a said quadrature-phase component also modulated in accordance with a pilot signal having a frequency spectrum falling outside of the frequency spectrum of said difference signal, and varying a characteristic of said pilot signal in a known functional dependence upon the gain of said quadrature-phase component.

38. An AM stereo demodulator comprising means for receiving at least two phase displaced AM carrier components, the amplitude of each said AM component being modulated in accordance with a corresponding one of first and second signals, with the phase displacement between said AM components varying in dependence upon characteristics of said first and second signals, and means for recovering said first and second signals from said AM carrier components in dependence upon said varying phase displacement.

39. An AM stereo demodulator as set forth in claim 38, wherein said means for receiving said at least two phase displaced AM carrier components also receives a third carrier component equally phase displaced from each of said two AM carrier components, and wherein said means for recovering said first and second signals comprises first means for demodulating the component of the vector sum of said AM carrier components which is in-phase with said third carrier component to thus recover an in-phase modulating signal, means for demodulating the component of said vector sum which is in phase-quadrature with said third carrier component to thus recover a quadrature-phase modulating signal, means for adjusting the gains of at least one of said in-phase and quadrature-phase modulating signals in accordance with said varying phase displacement, and means for matrixing said gain adjusted in-phase and quadrature-phase modulating signals to thereby recover said first and second signals therefrom.

40. An AM stereo demodulator as set forth in claim 38 wherein said means for recovering said first and second signals comprises first means for demodulating a first, phase stable component of the vector sum of said AM carrier components to thereby recover one demodulated signal, means for demodulating a second phase stable component of said vector sum to thereby recover another demodulated signal, said first and second phase stable components being in phase-quadrature with one another, means for adjusting the gains of at least one of said one and another demodulated signals in accordance with said varying phase displacement, and means for matrixing said gain adjusted one and another demodulated signals to thereby recover said first and second signals.

41. An AM stereo demodulator as set forth in claim 40, wherein said gain adjusting means comprises means for receiving a pilot signal modulated in accordance with said varying phase displacement, means for demodulating said pilot signal to recover a phase displacement indicating signal which varies in accordance with said varying phase displacement, and means for adjusting the gains of at least one of said one and another demodulated signals in accordance with said phase displacement indicating signal.

42. A QAM demodulator comprising means for receiving a QAM signal having a quadrature-phase component whose gain varies in accordance with variations in a pilot signal also received by said means, QAM demodulator means for demodulating said QAM signal to recover in-phase and quadrature-phase modulating signals therefrom, and means for adjusting the gain of said quadrature-phase modulating signal in accordance with said variations in said pilot signal so as to derive a gain stable quadrature-phase modulating signal therefrom.

43. An AM stereo demodulator comprising means for receiving a QAM signal having an in-phase component whose amplitude varies in accordance with the sum of at least first and second signals and a quadrature-phase component whose amplitude varies in accordance with the difference between said at least first and second signals, the gain of said quadrature-phase component varying in accordance with a pilot signal also received by said receiver means, QAM demodulator means for demodulating said QAM signal to recover in-phase and gain varying quadrature-phase modulating signals therefrom, means for adjusting the gain of said recovered, gain-varying quadrature-phase modulating signal in accordance with said variations in said pilot signal so as to derive a gain stable quadrature-phase modulating signal therefrom, and matrix means for matrixing said in-phase and gain stable quadrature-phase modulating signals so as to derive said first and second signals therefrom.

44. An AM stereo demodulator as set forth in claim 43, wherein said first and second signals of said QAM signal received by said receiving means correspond with third and fourth signals which have been phase shifted by 90° relative to one another at all frequencies of said third and fourth signals, and wherein said AM stereo demodulator further comprises complementary phase shifting means for phase shifting said recovered first and second signals by −90° relative to one another at all frequencies of said third and fourth signals to thereby restore the original phase relationships therebetween.

45. An AM stereo demodulator comprising means for receiving a modulated signal including upper and lower AM sidebands, each of said sidebands being amplitude modulated predominantly by a corresponding one of first and second signals but also by the other to an extent which varies in accordance with characteristics of said first and second signals, and means for recovering said first and second signals from said modulated signal in dependence upon the varying extent to which each of said sidebands is modulated by the other of said signals.

46. An AM stereo demodulator as set forth in claim 45, wherein said means for recovering said first and second signals includes means for receiving a pilot signal having a characteristic which varies in accordance with the varying extent to which each of said sidebands is modulated by the other of said signals, and means for recovering said first and second signals from said modulated signal under control of said pilot signal.

47. An AM stereo modulator as set forth in claim 29, wherein said means for varying the relative gains of said in-phase and quadrature-phase modulating signals comprises means for varying the gain of said in-phase modulating signal.

48. An AM stereo modulator as set forth in claim 29, wherein said means for varying the relative gains of said in-phase and quadrature-phase modulating signals comprises means for varying the gains of both said in-phase and quadrature-phase signals.

* * * * *